US011197085B2

(12) United States Patent
Woo et al.

(10) Patent No.: US 11,197,085 B2
(45) Date of Patent: Dec. 7, 2021

(54) EARPIECE WITH AN EARHOOK AND ADD-ON EARTIP

(71) Applicant: Motorola Solutions, Inc., Chicago, IL (US)

(72) Inventors: Kin Hee Woo, Gelang Patah (MY); Lee Sun Ooi, Kulim (MY)

(73) Assignee: Motorola Solutions, Inc., Chicago, IL (US)

( * ) Notice: Subject to any disclaimer, the term of this patent is extended or adjusted under 35 U.S.C. 154(b) by 32 days.

(21) Appl. No.: 16/722,875

(22) Filed: Dec. 20, 2019

(65) Prior Publication Data

US 2021/0195312 A1 Jun. 24, 2021

(51) Int. Cl.
*H04R 1/10* (2006.01)
*H04R 1/08* (2006.01)

(52) U.S. Cl.
CPC ..... *H04R 1/1066* (2013.01); *H04R 1/083* (2013.01); *H04R 1/105* (2013.01); *H04R 1/1016* (2013.01)

(58) Field of Classification Search
CPC .... H04R 1/1016; H04R 1/105; H04R 1/1066; H04R 2201/083
See application file for complete search history.

(56) References Cited

U.S. PATENT DOCUMENTS 5,712,453 A 1/1998 Bungardt et al.
5,757,944 A 5/1998 Jensen et al.
D645,458 S 9/2011 Silvestri et al.
8,254,621 B2 8/2012 Silvestri et al.
9,167,336 B2 * 10/2015 Siahaan ..... H04R 1/1016
9,788,099 B2 10/2017 Mainini et al.
2009/0226025 A1 9/2009 Howes et al.
2011/0096938 A1 * 4/2011 Yuan ..... A61F 11/06 381/73.1
2012/0121119 A1 * 5/2012 Saggio, Jr. ..... H04R 1/1016 381/380
2015/0237434 A1 8/2015 Tran et al.
2015/0358745 A1 12/2015 Rix et al.
2018/0122357 A1 * 5/2018 Thornock ..... G10K 11/1783

FOREIGN PATENT DOCUMENTS

CN 209030396 U 6/2019

OTHER PUBLICATIONS

International Search Report and Written Opinion of International Application No. PCT/US2020/064030, dated Mar. 10, 2021, 13 pages.

* cited by examiner

*Primary Examiner* — Regina N Holder
(74) *Attorney, Agent, or Firm* — Baker Botts L.L.P.

(57) ABSTRACT

An audio earphone device may include an earpiece configured to playback audio, an earhook attached to the earpiece, and an eartip removably attached to the earpiece. The earpiece may be configured to deliver audio to the ear with the removably attached eartip removed. The earhook may be configured to be placed around an ear to position an opening for a speaker of the earpiece over the cavum concha of the ear. The eartip may be configured to sit in the cavum concha of the ear and channel audio from the opening of the earpiece to the ear canal of the ear. The eartip may be removably attached to only a side of the earpiece that is configured to be proximate to the ear.

17 Claims, 17 Drawing Sheets

EARPIECE WITH AN EARHOOK AND ADD-ON EARTIP

BACKGROUND OF THE INVENTION

Feature rich portable electronic devices, including portable electronic communication devices, have evolved from simple analog devices to multifunction computing systems supporting multiple communication protocols. Devices may rely on a speaker for audio output and a microphone for audio input. The speaker and microphone may be integrated in the device and one or more remote devices, such as a remote speaker microphone or a headphone. The speaker of remote devices may be worn near an ear of a user and the microphone may be placed in proximity to the jaw or mouth of a user.

In public-safety or mission-critical environments, a user may need to discern ambient sounds and audio playback from the speaker over ambient noise. However, users in such environments cannot carry multiple types of remote devices for separately discerning ambient sounds and audio playback. In addition, users in such environments often need to wear the remote devices for extended periods without causing discomfort to the user. For example, one or more protrusions from the remote device may interface with the ear of the user thereby causing user discomfort and rendering the remote device unsuitable for public-safety or mission-critical environments. This limitation typically may not be overcome by removing the remote device because users in such environments may need to discern audio playback over extended periods.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Figure 1:
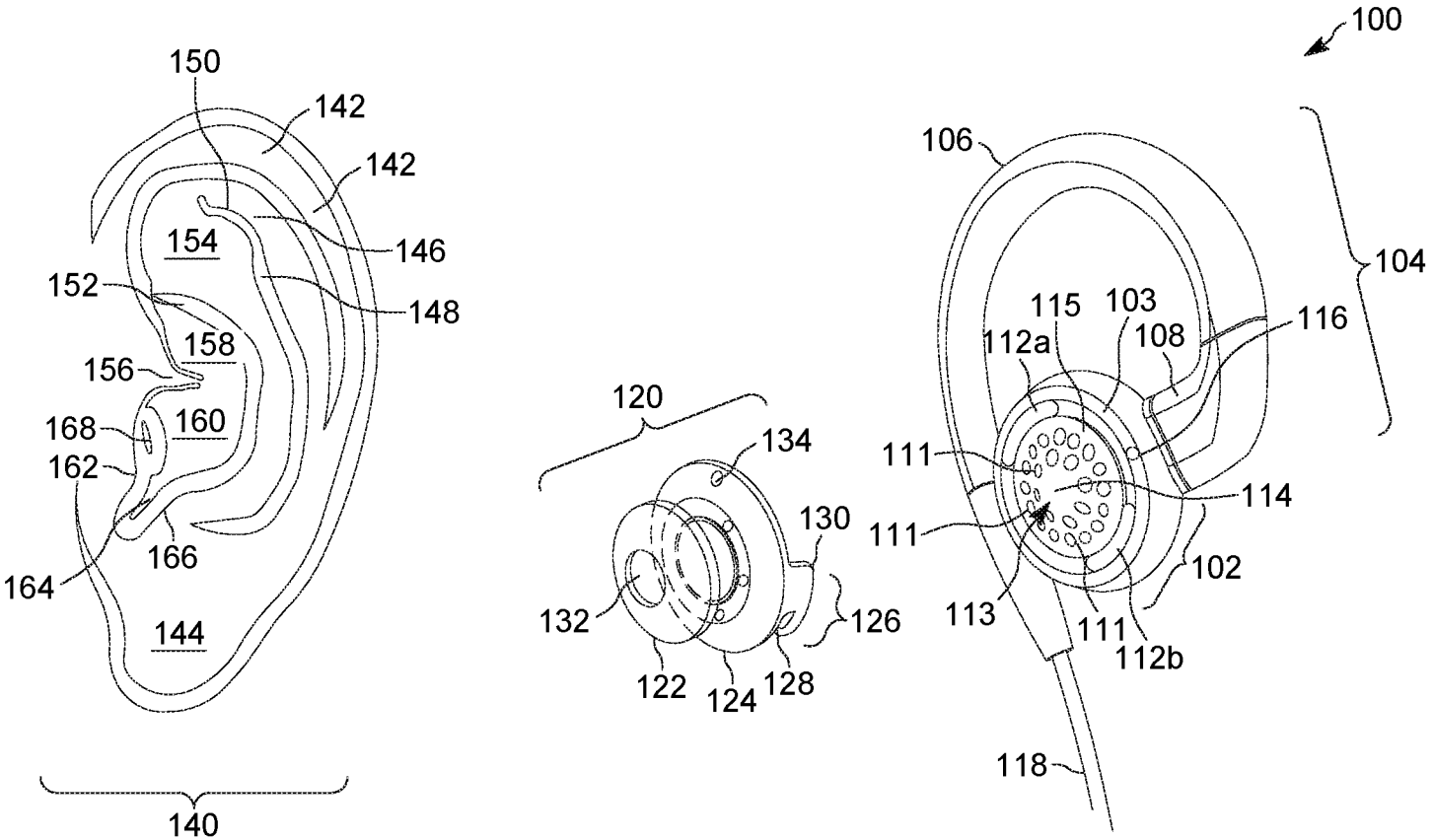
FIG. 1 is an exploded perspective view of an example audio earphone device to be installed on an ear, in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus components have been represented where appropriate by suitable symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Disclosed herein is an audio earphone device for public-safety or mission-critical environments. In one embodiment, a disclosed audio earphone device includes an earpiece, an earhook, and an eartip. The earpiece may be configured to playback audio, the earhook may be attached to the earpiece and configured to be placed around an ear to position an opening for a speaker of the earpiece over the cavum concha of the ear, and the eartip may be removably attached to the earpiece and configured to channel audio from the opening of the earpiece to the ear canal of the ear. The eartip may be removably attached to only a side of the earpiece that is proximate to the ear and configured to sit in the cavum concha. The earpiece may be configured to deliver audio to the ear with the removably attached eartip removed.

In various embodiments, a speaker grill of the earpiece with the opening for the speaker may have a conical shape and the apex of the speaker grill may extend from the earpiece. In various embodiments, the earhook may be configured to position the opening of the earpiece over the cavum concha of the ear using a loop configured to be placed around the helix of the ear. The loop of the earhook may comprise a molded rubber material with a wire embedded within the molded rubber material. In some embodiments, the molded rubber material may be silicone. In various embodiments, the eartip may be removably attached to the earpiece with a foot of the eartip configured to interlock the eartip to the earpiece. In various embodiments, a first sound intensity corresponding to audio configured to be delivered by the earpiece to the ear with the eartip removed may be lower than a second sound intensity corresponding to audio configured to be delivered by the earpiece and channeled by the eartip to the ear. In various embodiments, the earhook may be attached to the earpiece by an arm of the earhook. In some embodiments, the earpiece may be configured to be positioned closer to the ear than the arm of the earhook to which the earpiece is attached.

In some embodiments, the foot of the eartip may be configured to interlock the eartip to the earpiece by inserting the foot into a cavity of the earpiece and rotating the eartip to a locking position. The cavity of the earpiece may be recessed from the apex of the speaker grill. In some embodiments, the locking position may be identified by alignment between a first mark on the earpiece and a second mark on the eartip. The first and second marks may be provided by indentations or painted symbols, such as circles or dots. In some embodiments, the rotation of the eartip to the locking position may be configured to be performed on a plane of rotation orthogonal to an axis of the insertion of the foot of the eartip into the cavity of the earpiece.

In various embodiments, a distal end of the eartip may include a rubber attachment that is configured to isolate ambient sound from the ear canal. In various embodiments, the eartip may include a rubber attachment and a plastic base. The rubber attachment may be located on the distal end of the eartip, configured to be positioned in the cavum concha of the ear, and include a port configured to be positioned toward the ear canal. The plastic base may include the foot of the eartip on the proximate end of the eartip and may be co-molded to the rubber attachment to seal audio channeled from the opening of the speaker of the earpiece to the ear canal. In some embodiments, the rubber attachment may be silicone.

In various embodiments, a sloped edge of the foot may be formed between a first and second end of the foot. The first end may be distal to the plastic base of the eartip and the second end may be proximate to the plastic base. The sloped edge may be configured to secure the eartip to the earpiece via contact with a wall of a cavity of the earpiece. In some embodiments, the cavity may be recessed into a base of the earpiece that is configured to house the speaker of the earpiece. In some embodiments, the sloped edge may be configured to interlock the eartip to the earpiece by interfacing with a wall of a cavity of the earpiece. In some embodiments, a curvature of the foot may correspond to the curvature of a cavity or a base of the earpiece that is configured to house the speaker of the earpiece. In various embodiments, the plastic base of the eartip may be configured to be substantially flush with the earpiece when the eartip is interlocked with the earpiece.

In various embodiments, the earpiece may be configured to deliver audio having a first sound pressure level to the ear and the eartip may be configured to channel audio having a second sound pressure level to the ear in which the second sound pressure level is less than 15 decibels greater than the first sound pressure level.

As previously noted, portable electronic devices may integrate a speaker and microphone. The speaker and microphone may be increasingly used for communications and commands as the use and benefit of communications and commands grows. At the same time, in public-safety or mission-critical environments, the ambient noise level may be louder than normal environments and may require increased sound intensity or increased sound isolation, as perceived by a user to discern ambient sounds and audio output from the speaker. The speaker or speaker and microphone may be integrated in a remote device mounted in proximity to one or more ears.

A remote device may be mounted in general to an ear and generate audio with a sound intensity that is appropriate for normal environments but unsuitable for public-safety or mission-critical environments, which may require delivery of audio of sufficient sound intensity for a user to discern audio output from the speaker over ambient noises.

A remote device may also include a snap-on earbud. Secure snap-on installation or snap-off removal of the earbud generally relies on a clip, but the clip protrudes from the earbud and interfaces with the concha of a user's ear resulting in discomfort during periods of use typical of public-safety and mission-critical environments.

A remote device may include a sleeve to mount the device to the ear, but is mounted within the concha of the ear resulting generally in user discomfort and the device cannot be mounted reliably without the sleeve. In addition, user discomfort stems from the sleeve covering the device, thereby increasing its size, and interfacing with the antihelix of the ear. The interface of the sleeve with the ear may include one or more protruded edges interfacing with a surface of the ear, which is also uncomfortable for at least some users.

Public-safety and mission-critical environments may demand that users discern audio output from a device and ambient audio. To support these demands, a user may need to switch between an audio earphone device with an eartip, which may provide improved sound intensity for audio output or audio isolation for a user to discern audio output from the device, and an audio earphone device without an eartip, which may provide improved ambient audio recognition. At the same time, users may not be able to carry multiple types of devices while operating in a public-safety or mission-critical environment.

Audio earphone devices may be communicatively coupled to devices, such as radios, that may support one or more types of transmission for communications, including but not limited to a direct-mode, conventional, or trunked land mobile radio (LMR) standard or protocol such as ETSI Digital Mobile Radio (DMR), a Project 25 (P25) standard defined by the Association of Public Safety Communications Officials International (APCO), Terrestrial Trunked Radio (TETRA), or other LMR radio protocols or standards. In some embodiments, devices may support a Long Term Evolution (LTE) (including LTE-Advanced or LTE-Advanced Pro compliant with, for example, the 3GPP TS 36 specification series) or 5G (including a new radio (NR) air interface compliant with the 3GPP TS 38 specification series) protocol, among other possibilities, over which multimedia broadcast multicast services (MBMS), single site point-to-multipoint (SC-PTM) services, or Mission Critical Push-to-talk (MCPTT) services may be provided, or over which an open mobile alliance (OMA) push to talk (PTT) over cellular (OMA-PoC), a voice over IP (VoIP), an LTE Direct or LTE Device to Device, or a PTT over IP (PoIP) application may be implemented. Direct mode LTE standards may additionally or alternatively be implemented as well, including but not limited to the LTE Direct device-to-device standard.

As described herein, an audio earphone device for public-safety or mission-critical environments may include an earpiece, an earhook, and an eartip. The earpiece may be configured to playback and deliver audio to the ear with the eartip removed, which may allow a user to hear ambient sounds and audio associated with communications. An apex of a conical shaped speaker grill of the earpiece may extend from the base of the earpiece toward the cavum concha of the ear. The earhook may be attached to the earpiece and configured to be placed around an ear to position an opening for a speaker of the earpiece over the cavum concha of the ear. The eartip may be removably attached to one side of the earpiece that is proximate to the ear. For example, a foot of the eartip may be inserted in a cavity of the earpiece and rotated to interlock the eartip to the earpiece, which thereby securely attaches the eartip to the earpiece. The foot and cavity may be located on outside of the speaker when the eartip is attached to the earpiece. In addition, the eartip may be configured to sit in the cavum concha of the ear and channel audio from the opening of the earpiece to the ear canal. When the eartip is attached, the audio earphone device may be more securely mounted to the ear with a more comfortable fit for a user.

This approach may enable users to carry one type of audio earphone device, such as a pair of earphones, which may provide improved sound intensity for audio output or improved audio isolation for a user to discern audio output from the device when the eartip is attached to the earpiece or provide improved ambient audio recognition when the eartip is removed from the earpiece. This approach may also enable the earpiece to be positioned over the cavum concha rather than in the cavum concha for improved user comfort while delivering audio to the ear canal using a conical shaped speaker grill. This approach may also enable the use of a larger driver for the speaker of the earpiece, including but not limited to a 13.5 mm driver, because the earpiece may be positioned over the cavum rather than within the cavum. This approach may further enable a locking mechanism for the eartip, including but not limited to a cavity, to be located outside the speaker in the base of the earpiece, rather than towards the center of the earpiece, which may improve user comfort when the eartip is attached to the earpiece and enable the earpiece to be placed closer over the cavum concha of the ear.

When the eartip is attached to the device, the eartip may be located in the cavum concha to channel audio from the earpiece to the ear canal. The eartip may be inserted into the earpiece and rotated to a locking position to interlock the eartip to the earpiece. The base of the eartip may be substantially flush with the base of the earpiece when the eartip is interlocked with the earpiece, which may enable a seamless fit without any protruding edges that would ordinarily be uncomfortable for users. This approach may enable the earpiece to remain the same size when attached to the eartip without changing the fit and comfort for a user. In addition, the base of the eartip may be a plastic that is co-molded to a rubber attachment of the eartip. This approach may seal audio channeled from an opening of the speaker grill to the ear canal while reducing the amount of audio leakage from the eartip.

An arm and loop of the earhook may enable the earpiece to be placed over the cavum concha. The arm may be attached to the earpiece to position the earpiece closer to the ear than the arm. The arm may also extend out to the loop that begins near the helix of the ear. The arm may be comprised of a hard plastic and the loop may be comprised of a molded rubber material that is soft-touch, such as silicone. This approach may enable better placement of the earpiece over the concha of the ear, such as the cavum concha and cymba concha, rather than over the anti-helix or inferior crus. This approach may also enable better user comfort by using hard plastics for the arm that supports the earpiece and that may not interface with a surface of the ear and by using molded rubber material for the loop that may interface with the helix of the ear.

Referring now to FIG. 1, there is provided an exploded perspective view of an example audio earphone device 100 to be installed on an ear 140, in accordance with some embodiments. The ear 140 includes a helix 142, lobule 144, scapha 146, and anti-helix 148. The triangular fossa 154 is formed by the helix 142, superior crus 150, and inferior crus 152. The concha of the ear is formed by tragus 162, anti-tragus 166, and the inferior crus 152. The concha is separated into the cymba concha 158 and cavum concha 160 by the helicis crus 156. The concha also includes the intertragic notch 164 and leads to the opening for the ear canal 168.

Audio earphone device 100 may include an earpiece 102, earhook 104, and removable eartip 120. Although one earpiece 102, earhook 104, and removable eartip 120 are shown, audio earphone device 100 may include an earphone, which may include an earpiece 102, earhook 104, and removable eartip 120, for each of a user's two ears. The pair of earphones may be communicatively coupled by a wired or wireless interface. Earpiece 102 may include a base 103 that houses a speaker (not shown), and one or more cavities for securing an eartip, such as superior cavity 112*a* and inferior cavity 112*b*. Cavities 112 may be recessed into the base 103 of earpiece 102 to avoid a protruding edge that may otherwise interface with a surface of the ear 140. In addition, the cavities 112 may be located outside the speaker in the base 103 of the earpiece 102, rather than towards the center of earpiece 102. Although a superior cavity 112*a* and an inferior cavity 112*b* are shown, one or more cavities may be positioned at any suitable location around the speaker.

The speaker may be covered with speaker grill 113 to protect one or more components of the speaker from damage, including but not limited to the diaphragm of the speaker. Speaker grill 113 may include one or more openings 111 to allow sound to be transmitted away from the speaker of the earpiece 102. Although a plurality of circular openings 111 are shown, any number of openings 111 having any suitable shape may be used to transmit sound from the speaker. Speaker grill 113 may form a conical shape with a base 115 and an apex 114. Base 115 of speaker grill 113 may be configured to be further away from the cavum of a user's ear than apex 114, which may provide improved comfort by avoiding interactions between a surface of the ear 140 and a surface of speaker grill 113. In addition, openings 111 of speaker grill 113 may at least partially channel sound from the speaker to the opening of the ear canal 168, which may provide improved sound intensity at the ear 140. Apex 114 of speaker grill 113 may extend from the base 103 of earpiece 102 toward the opening of the ear canal 168, which may improve the sound intensity of audio delivered to the ear. In some embodiments, the base 115 of speaker grill 113 may be recessed relative to the base 103 of earpiece 102. The recessed location may improve the secure fit of an eartip and ensure that earpiece 102 be placed over the cavum concha, rather than in the cavum concha, which may improve user comfort. The speaker of earpiece 102 that may be placed over the cavum concha rather than in the cavum concha may use a larger driver, such as a 13.5 mm driver, which may increase the sound intensity of audio output from the speaker.

Earhook 104 may include arm 108 to attach earhook 104 to earpiece 102 and position earpiece 102 closer to ear 140 than arm 108. Arm 108 may comprise a plastic material, such as a hard plastic, and allow adjustment of the earhook 104 by rotating earhook 104 around the earpiece 102. Earhook 104 may also include loop 106 to securely attach audio earphone device 100 by placing loop 106 over or behind one or more portions of the ear 140, such as the helix 142. Loop 106 may comprise a molded rubber material, such as silicone, that may enclose an embedded wire 118, also known as a cable. The molded rubber material may be a soft-touch material to improve user comfort, and loop 106 may be bent or otherwise adjusted to improve fit around or behind an ear.

Wire 118 may transmit and receive signals to convey audio information, such as signals necessary to drive the speaker of earpiece 102. In at least some embodiments, the signals may be transmitted or received as digital signals. For example, earpiece 102 may receive digital signals conveying audio information and convert the digital signals into analog signals for driving the speaker of earpiece 102 to generate audio output. Although wire 118 is shown, audio earphone device 100 may be battery-powered and may use wireless communication to transmit audio information.

One or more microphones for audio recording or ambient noise cancellation may be integrated into audio earphone device 100. For example, earpiece 102, earhook 104, or wire 118 may include one or more microphones that may be embedded or placed in-line. As another example, earpiece 102 may be attached to a microphone boom (not shown) that is configured to extend from a position near an ear of a user to a position near the mouth of a user.

Earpiece 102 may be removably attached to eartip 120, which may include a base 124 on the proximate end closest to earpiece 102 and rubber attachment 122 on the distal end furthest from earpiece 102. In some embodiments, base 124 may comprise a plastic piece, which may be co-molded to rubber attachment 122. Eartip 120 may be removably attached to one side of earpiece 102 that is proximate to ear 140. Base 124 may include one or more feet 126 to attach eartip 120 to earpiece 102 in a secure manner. For example, foot 126 may include a first end 128 and a second end 130. First end 128 may be distal to base 124 and second end 130 may be proximate to base 124. Between first end 128 and second end 130, a sloped edge, also known as a tapered edge, may be formed to improve installation of eartip 120 in earpiece 102. The sloped edge may be configured to interlock the eartip to the earpiece by interfacing with a wall of a cavity of the earpiece, such as a wall of cavity 112*a* or 112*b* of earpiece 102. In some embodiments, the foot may be formed with a curvature, which may correspond to the curvature of a cavity, such as cavity 112*a* or 112*b*, or a base, such as base 103 of earpiece 102. For example, one or more feet 126 of eartip 120 may be inserted in one or more corresponding cavities 112 of earpiece 102 and after insertion eartip 120 may be rotated along a plane orthogonal to the direction of insertion relative to earpiece 102. A notification of a locking position may be provided by mark 116 on earpiece 102 and mark 134 on eartip 120. Marks 116 and 134 may be provided by indentations or painted symbols, such as circles or dots, on the surface of earpiece 102 and eartip 120. When marks 116 and 134 align, eartip 120 may be securely attached to earpiece 102. Conversely, eartip 120 may be removed from earpiece 102 by rotating eartip 120 relative to earpiece 102 such that marks 116 and 134 are no longer aligned and then pulling on eartip 120 to separate it from earpiece 102 once the one or more feet 126 of eartip 120 align with the one or more corresponding cavities 112 of earpiece 102.

When eartip 120 is attached to earpiece 102, the base 124 of eartip 120 may be substantially flush with the base 103 of earpiece 102 in which there may be no protruding edges from the base 124 of eartip 120 or base 103 of earpiece 102 that could otherwise result in discomfort during periods of use typical of public-safety and mission-critical environments. Audio output from the speaker grill 113 of earpiece 102 may be channeled to the ear canal by rubber attachment 122 of the eartip 120 via port 132. A user may select an eartip 120 with the appropriately sized rubber attachment 122 that isolates audio from the ear canal without adversely interacting with the ear, which ordinarily may cause discomfort.

Figure 2:
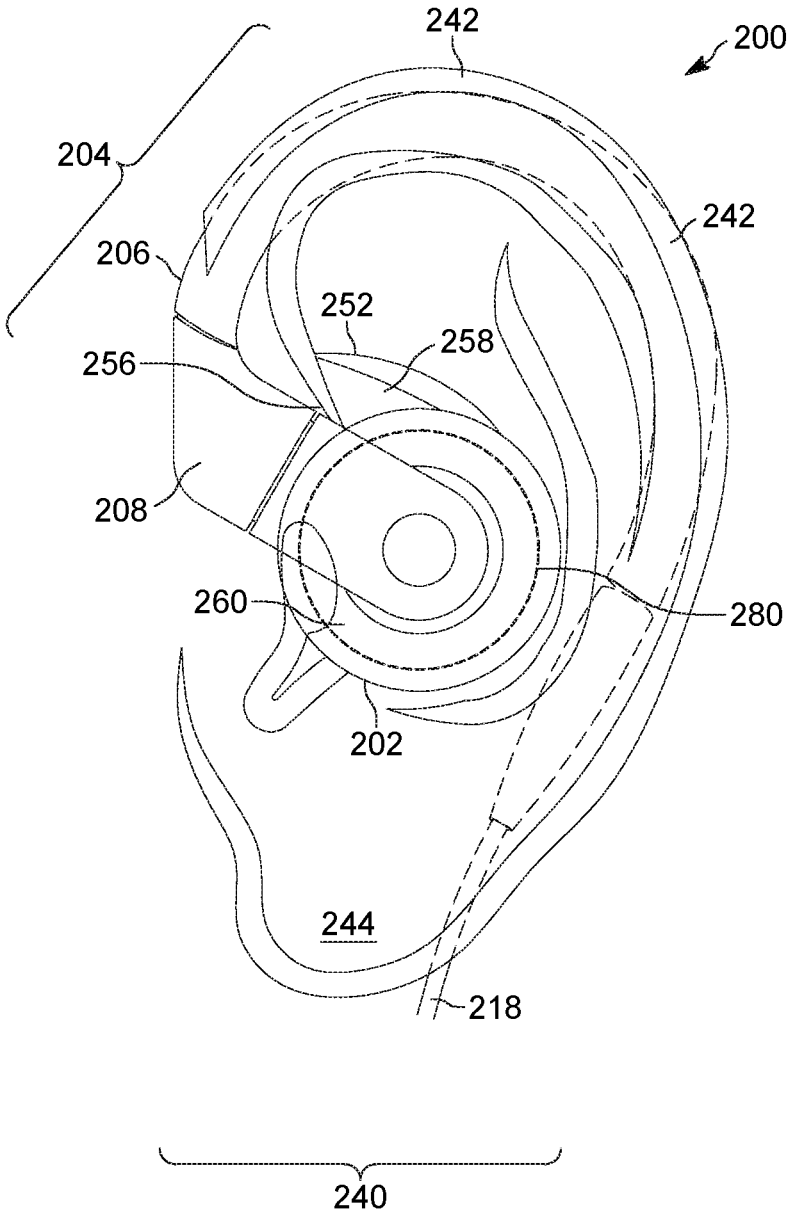
FIG. 2 is a front orthogonal view of an example audio earphone device installed on an ear, in accordance with some embodiments.

Referring now to FIG. 2, there is provided a front orthogonal view of an example audio earphone device 200 installed on an ear, in accordance with some embodiments. The earhook 204 of audio earphone device 200 may provide a secure mount of audio earphone device 200 to ear 240. The loop 206 of earhook 204 may be at least partially placed behind a portion of the ear, such as helix 242 of ear 240. Loop 206 may comprise a molded rubber material, such as silicone, that may enclose an embedded wire 218, which may exit below the lobule 244 of the ear 240. In some embodiments, earhook 204 may be adjusted by bending loop 206. Earhook 204 may be attached to earpiece 202 with arm 208, which may comprise a plastic material. The arm 208 of earhook 204 may be at least partially placed in front of the ear, such as the helicis crus 256 of ear 240. In some embodiments, earhook 204 may be adjusted by rotating arm 208 of earhook 204 relative to earpiece 202. The rotation may move arm 208 toward or away from inferior crus 252 of ear 240.

Earhook 204 may position earpiece 202 over the cavum concha 260 of ear 240 in region 280, which may prevent earpiece 202 from being placed within the cavum concha 260 or being positioned further forward thereby leaving one or more regions near the rear of the cavum concha 260 uncovered. Region 280 may also cover one or more additional regions of the ear 240, such as the cymba concha 258, because earpiece 202 may not interface with the surface of the ear 240 in those regions which otherwise may cause user discomfort.

Figure 3:
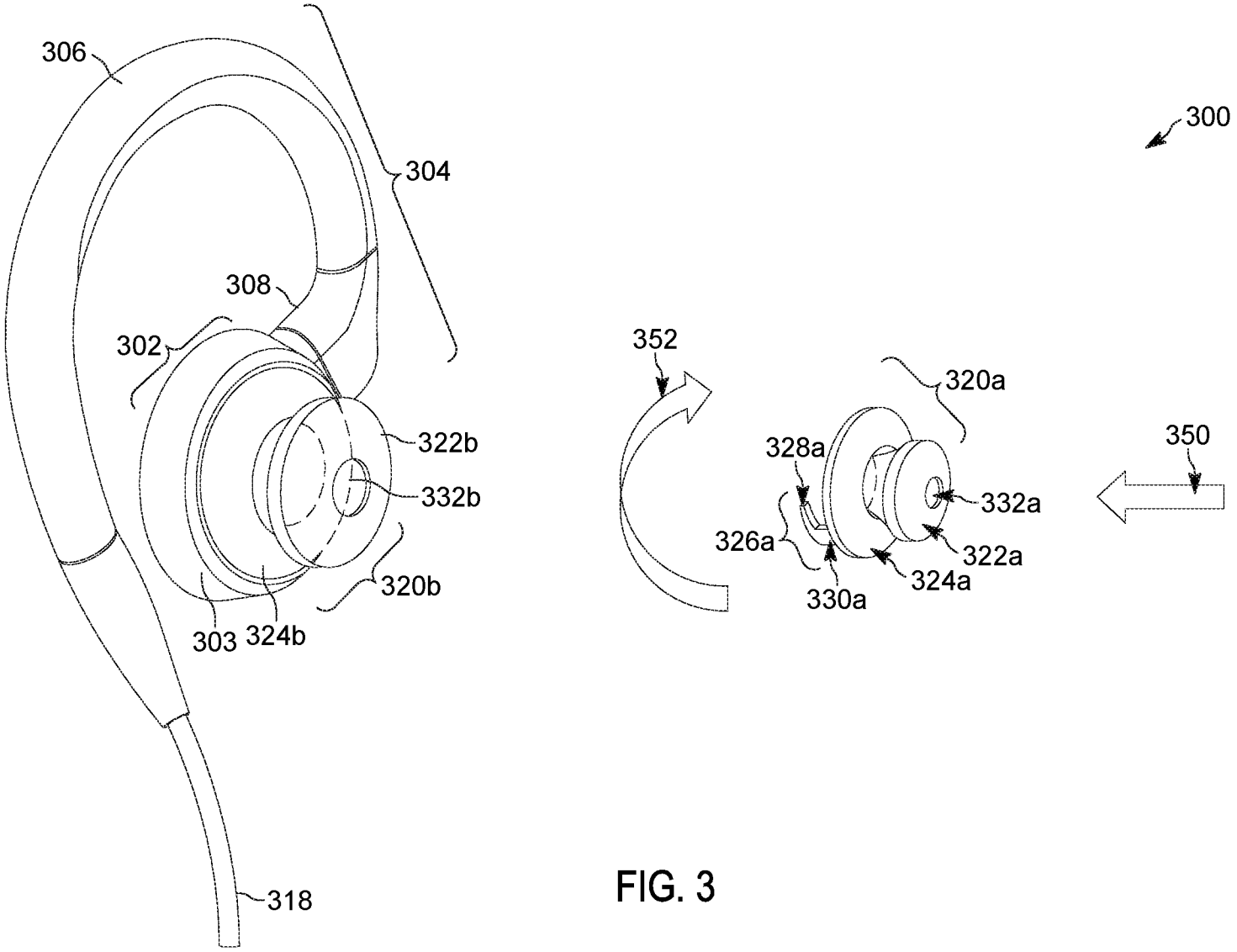
FIG. 3 is a perspective view of an example audio earphone device with an eartip, in accordance with some embodiments.
Figure 4A:
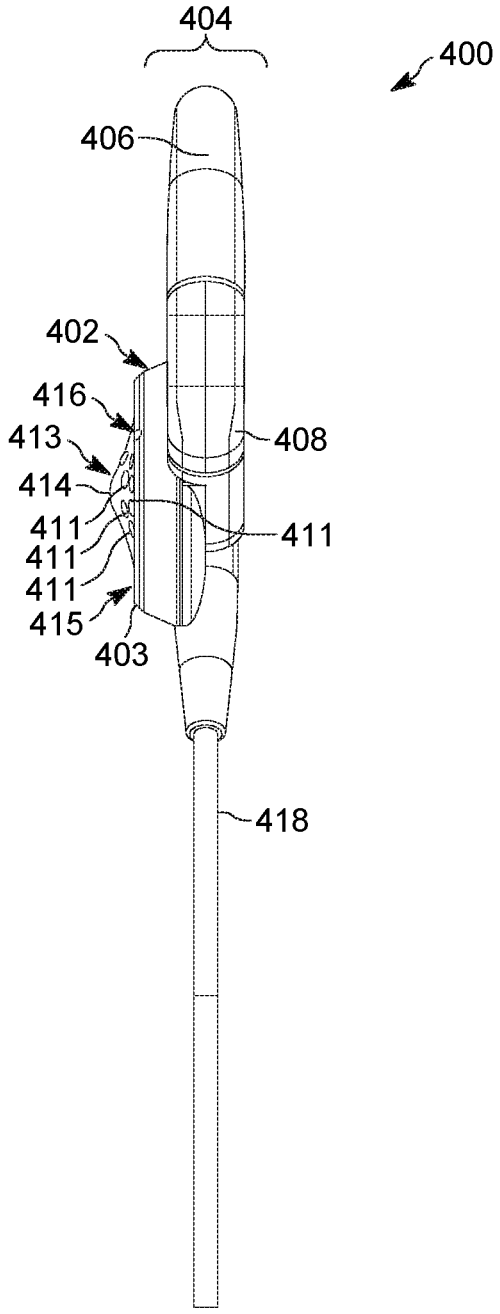
FIG. 4A is a left side orthogonal view of an example audio earphone device without an eartip, in accordance with some embodiments.
Figure 4B:
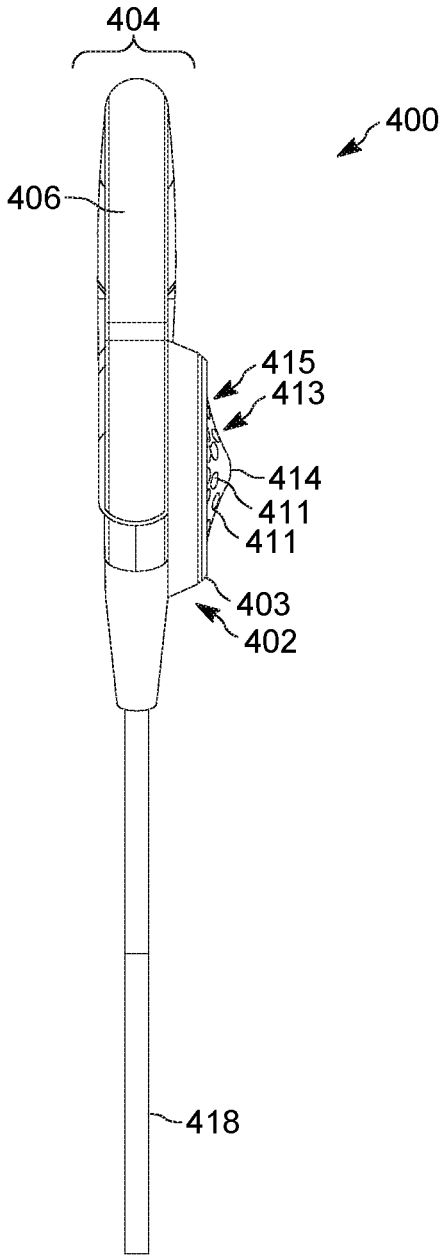
FIG. 4B is a right side orthogonal view of an example audio earphone device without an eartip, in accordance with some embodiments.
Figure 4C:
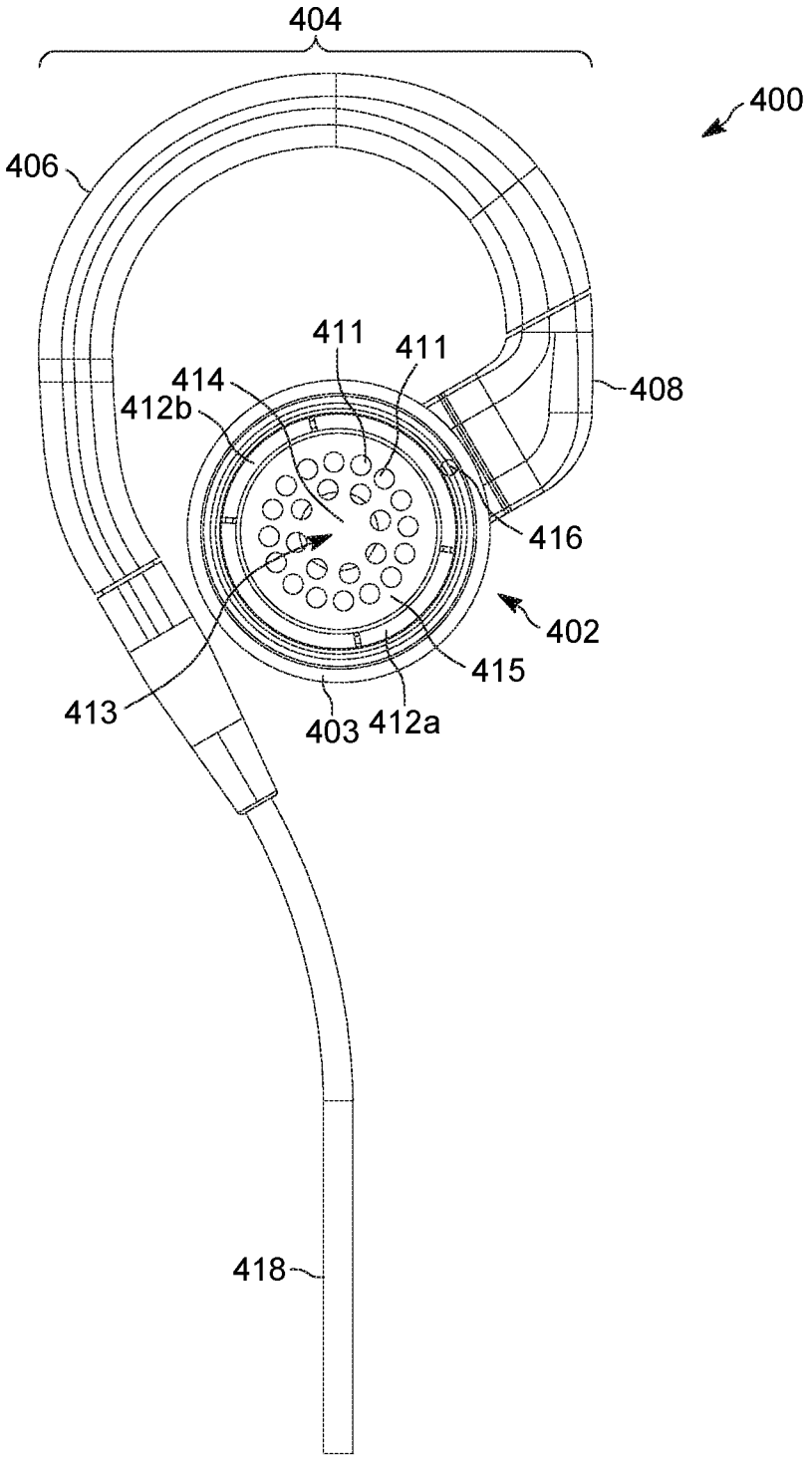
FIG. 4C is a rear orthogonal view of an example audio earphone device without an eartip, in accordance with some embodiments.
Figure 4D:
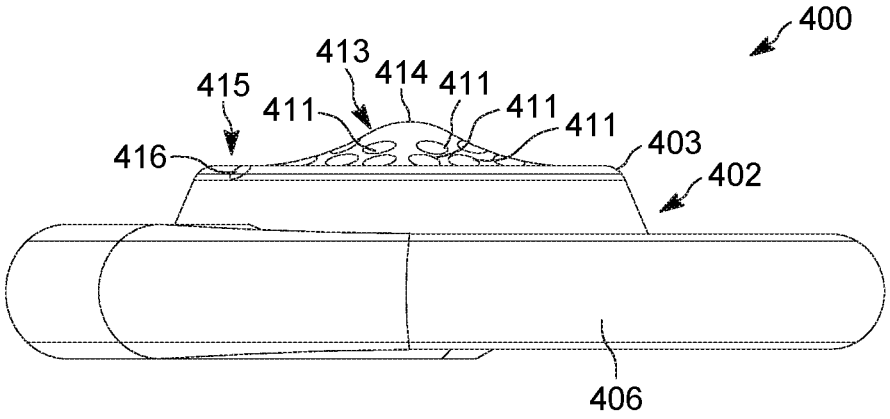
FIG. 4D is a top orthogonal view of an example audio earphone device without an eartip, in accordance with some embodiments.
Figure 4E:
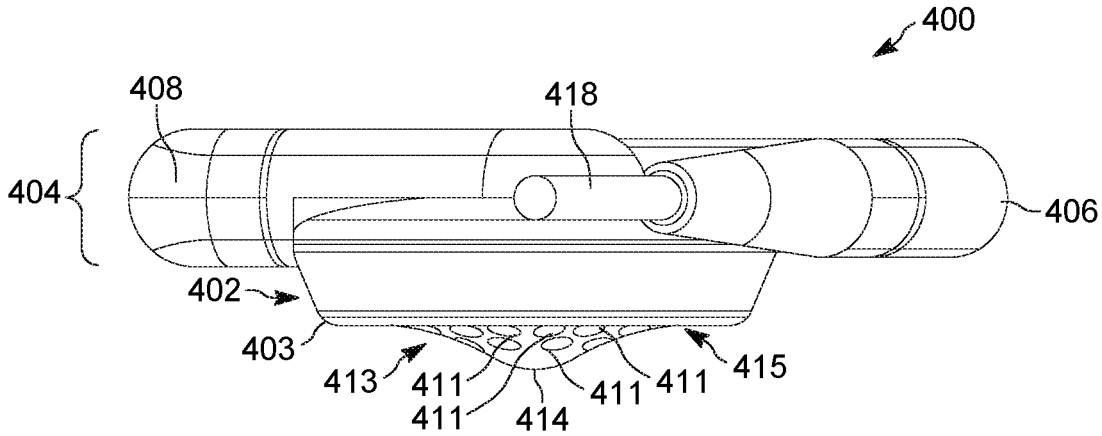
FIG. 4E is a bottom orthogonal view of an example audio earphone device without an eartip, in accordance with some embodiments.
Figure 5A:
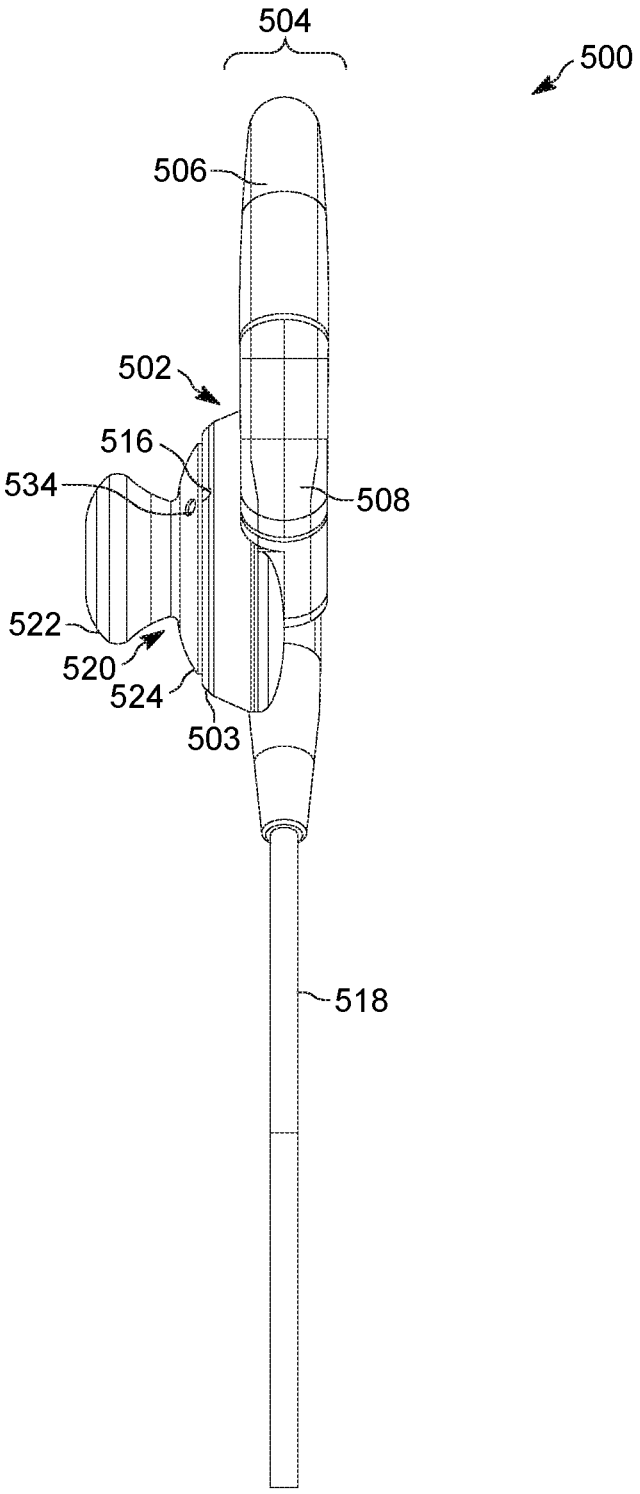
FIG. 5A is a left side orthogonal view of an example audio earphone device with an eartip, in accordance with some embodiments.
Figure 5B:
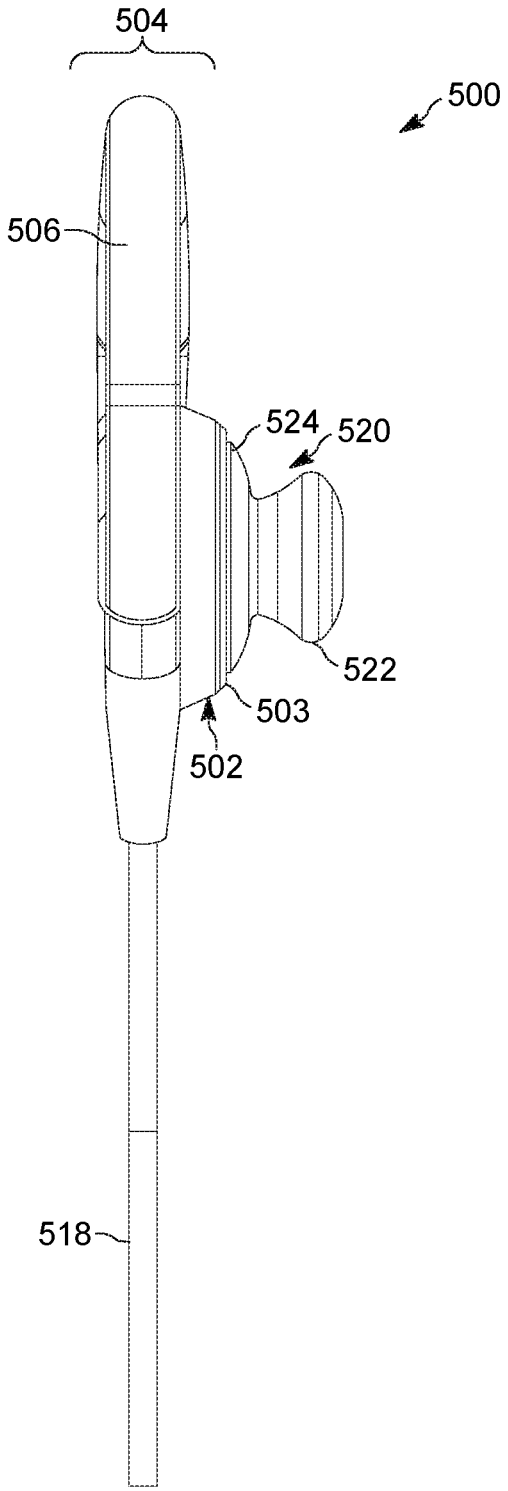
FIG. 5B is a right side orthogonal view of an example audio earphone device with an eartip, in accordance with some embodiments.
Figure 5C:
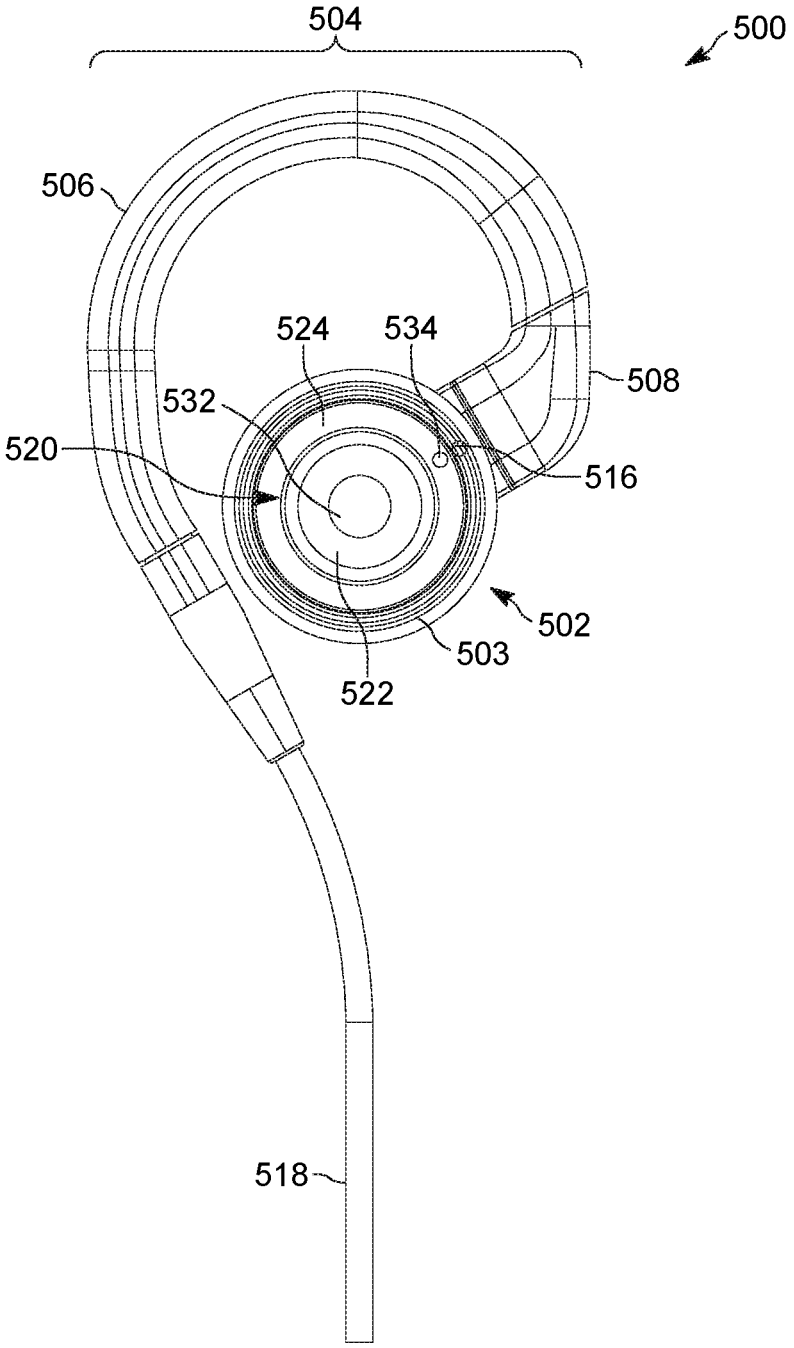
FIG. 5C is a rear orthogonal view of an example audio earphone device with an eartip, in accordance with some embodiments.
Figure 5D:
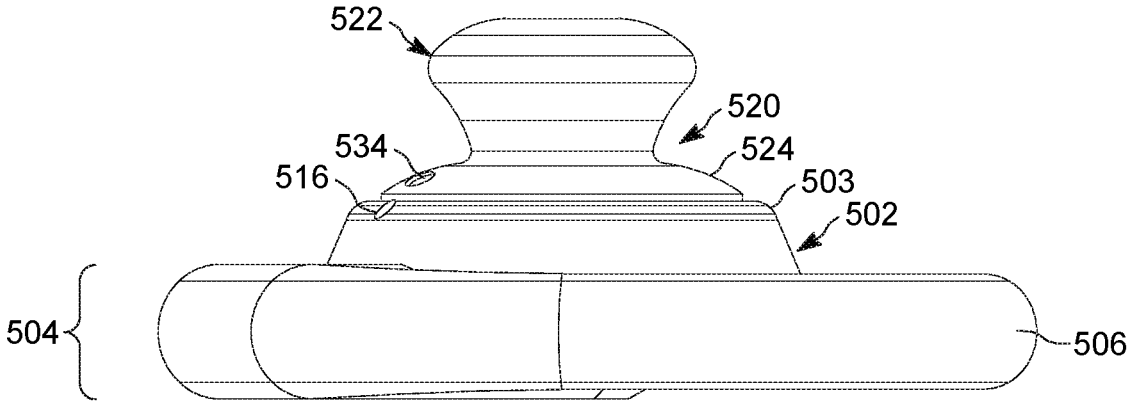
FIG. 5D is a top orthogonal view of an example audio earphone device with an eartip, in accordance with some embodiments.
Figure 5E:
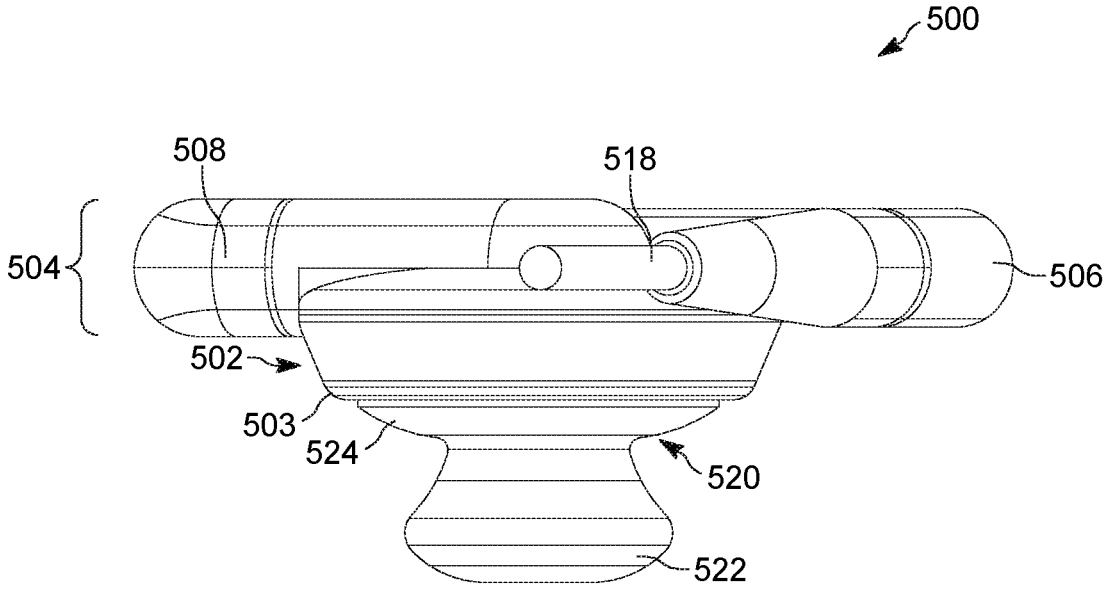
FIG. 5E is a bottom orthogonal view of an example audio earphone device with an eartip, in accordance with some embodiments.

Referring now to FIG. 3, there is provided a perspective view of an example audio earphone device 300 with an eartip 320*b*, in accordance with some embodiments. Eartip 320*a* may represent an eartip prior to installation in earpiece 302 and eartip 320*b* may represent an eartip after installation in earpiece 302. Eartip 320*a* may include a base 324*a* on the proximate end closest to earpiece 302 and a rubber attachment 322*a* on the distal end furthest from earpiece 302. In some embodiments, base 324*a* may comprise a plastic piece, which may be co-molded to rubber attachment 322*a*. Rubber attachment 322*a* may have a port 332*a* on its distal end to channel audio to the opening of an ear canal.

Base 324*a* may include one or more feet 326*a* to attach eartip 320*a* to earpiece 302 in a secure manner, as shown by eartip 320*b*. For example, foot 326*a* may include a first end 328*a* and a second end 330*a*. First end 328*a* may be distal to base 324*a* and second end 330*a* may be proximate to base 324*a*. Between first end 328*a* and second end 330*a*, a sloped edge, also known as a tapered edge, may be formed to improve installation of eartip 320*a* in earpiece 302. The sloped edge may be configured to interlock the eartip to the earpiece via contact by interfacing with a wall of a cavity of the earpiece, such as cavity 112*a* or 112*b* of earpiece 102 as described for FIG. 1. In some embodiments, the foot may be formed with a curvature, which may correspond to the curvature of a cavity or a base, such as base 303 of earpiece 302. For example, one or more feet 326*a* of eartip 320*a* may be inserted 350 in one or more corresponding cavities of earpiece 302. After insertion 350, eartip (320*a* or 320*b*) may be rotated 352 along a plane orthogonal to the direction of insertion relative to earpiece 302. A notification of a locking position may be provided by a mark (not shown) on earpiece 302 and a mark (not shown) on eartip 320*b*. When the two marks align, eartip 320*b* may be securely attached to earpiece 302. Conversely, eartip 320*b* may be removed from earpiece 302 by rotating eartip 320*b* relative to earpiece 302 such that the two marks are no longer aligned and then pulling eartip 320*b* to separate it from earpiece 302 once the one or more feet, such as feet 326*a* of eartip 320*a*, align with the one or more corresponding cavities (not shown) of earpiece 302.

When eartip 320*b* is attached to earpiece 302, the base 324*b* of eartip 320*b* may be substantially flush with the base 303 of earpiece 302 in which there may be no protruding edges from the base 324*b* of eartip 320*b* or base 303 of earpiece 302 that could otherwise result in discomfort during periods of use typical of public-safety and mission-critical environments. Audio output from earpiece 302 may be channeled to the ear canal by rubber attachment 322*b* of the eartip 320*b* via port 332*b*. A user may select an eartip 320*b* with the appropriately sized rubber attachment 322*b* that isolates audio from the ear canal without adversely interacting with the ear, which ordinarily may cause discomfort. The configuration of the wire 318 and earhook 304, including an arm 308 and loop 306 of the earhook 304, may remain unchanged between configurations of earpiece 302 that attach or remove eartip 320*b*.

Referring now to FIGS. 4A to 4E, there is provided a left side orthogonal view (FIG. 4A), a right side orthogonal view (FIG. 4B), a rear orthogonal view (FIG. 4C), a top orthogonal view (FIG. 4D), and a bottom orthogonal view (FIG. 4E) of an example audio earphone device 400 without an eartip, in accordance with some embodiments. Audio earphone device 400 may include an earpiece 402 and earhook 404. Although one earpiece 402 and earhook 404 are shown, audio earphone device 400 may include an earphone, which may include earpiece 402 and earhook 404, for each of a user's two ears. The pair of earphones may be communicatively coupled via a wired or wireless interface.

Earpiece 402 may include base 403 that houses a speaker (not shown) and one or more cavities for securing an eartip, such as superior cavity 412*a* and inferior cavity 412*b*. Cavities 412 may be recessed into the base 403 of earpiece 402 to avoid a protruding edge that may otherwise interface with a surface of the ear. In addition, the cavities 412 may be located outside the speaker in the base 403 of the earpiece 402, rather than towards the center of earpiece 402. Although a superior cavity 412*a* and inferior cavity 412*b* are shown, one or more cavities may be positioned any suitable location around the speaker. Mark 416 may provide a notification of secure fit when a mark on the eartip aligns with mark 416. Mark 416 may be provided by an indentation or painted symbol, such as a circle or dot, on the surface of earpiece 402.

The speaker may be covered with a speaker grill 413 to protect one or more components of the speaker from damage, including but not limited to the diaphragm of the speaker. Speaker grill 413 may include one or more openings 411 to allow sound to be transmitted away from the speaker of earpiece 402. Although a plurality of circular openings 411 are shown, any number of openings having any suitable shape may be used to transmit sound from the speaker. Speaker grill 413 may form a conical shape with a base 415 and an apex 414. Base 415 of speaker grill 413 may be configured to be further away from the cavum of a user's ear than apex 414, which may provide improved comfort by avoiding interactions between a surface of the ear and a surface of speaker grill 413. In addition, openings 411 may at least partially channel sound from the speaker to the opening of the ear canal, which may provide improved sound intensity at the ear. Apex 414 of speaker grill 413 may extend from the base 403 of earpiece 402 toward the opening of the ear canal, which may improve the sound intensity of audio delivered to the ear. In some embodiments, the base 415 of speaker grill 413 may be recessed relative to the base 403 of earpiece 402, which may ensure that earpiece 402 be placed over the cavum concha, rather than in the cavum concha, which may improve user comfort. The speaker of earpiece 402 that may be placed over the cavum concha rather than in the cavum concha may use a larger driver, such as a 13.5 mm driver, which may increase the sound intensity of audio output from the speaker.

Earhook 404 may include arm 408 to attached earhook 404 to earpiece 402 and position earpiece 402 closer to the ear than arm 408. Arm 408 may comprise a plastic material and allow adjustment of the earhook by rotating the earhook around the earpiece. Earhook 404 may also include loop 406 to securely attach audio earphone device 400 to an ear by placing at least a portion of loop 406 over or behind one or more portions of the ear, such as the helix. Loop 406 may comprise a molded rubber material, such as silicone, that may enclose an embedded wire 418, which may exit below the lobule of the ear. The molded rubber material may be a soft-touch material to improve user comfort, and loop 406 may be bent or otherwise adjusted to improve fit around or behind an ear. The arm 408 of earhook 404 may be at least partially placed in front of the ear, such as the helicis crus of an ear. In some embodiments, earhook 404 may be adjusted by rotating arm 408 of earhook 404 relative to earpiece 402. The rotation may move arm 408 toward or away from the inferior crus of an ear. Earhook 404 may position earpiece 402 over the cavum concha of an ear, which may prevent earpiece 402 from being placed within the cavum concha or being positioned further forward thereby leaving one or more regions near the rear of the cavum concha uncovered. Earpiece 402 may also cover one or more additional regions of an ear, such as the cymba concha, because earpiece 402 may not interface with the surface of the ear in those regions which otherwise may cause user discomfort.

Wire 418 may transmit and receive signals to convey audio information, such as signals necessary to drive the speaker of earpiece 402. In at least some embodiments, the signals may be transmitted or received as digital signals. For example, earpiece 402 may receive digital signals conveying audio information and convert the digital signals into analog signals for driving the speaker of earpiece 402 to generate audio output. Although wire 418 is shown, audio earphone device 400 may be battery-powered and may use wireless communication to transmit audio information.

One or more microphones for audio recording or ambient noise cancellation may be integrated into audio earphone device 400. For example, earpiece 402, earhook 404, or wire 418 may include one or more microphones that may be embedded or placed in-line. As another example, earpiece 402 may be attached to a microphone boom (not shown) that is configured to extend from a position near an ear of a user to a position near the mouth of a user.

Referring now to FIGS. 5A to 5E, there is provided a left side orthogonal view (FIG. 5A), a right side orthogonal view (FIG. 5B), a rear orthogonal view (FIG. 5C), a top orthogonal view (FIG. 5D), and a bottom orthogonal view (FIG. 5E) of an example audio earphone device 500 with an eartip 520, in accordance with some embodiments. Audio earphone device 500 may include an earpiece 502, earhook 504, and removable eartip 520. Although one earpiece 502, earhook 504, and removable eartip 520 are shown, audio earphone device 500 may include an earphone, which may include an earpiece 502, earhook 504, and removable eartip 520, for each of a user's two ears. The pair of earphones may be communicatively coupled by a wired or wireless interface. Earpiece 502 may include a base 503 that houses a speaker (not shown), and one or more cavities (not shown) for securing eartip 520. Eartip 520 may be removably attached to one side of earpiece 502 that is configured to be proximate to the ear. Earpiece 502 may be placed over the cavum concha, rather than in the cavum concha, and eartip 520 may be placed in the cavum concha to channel audio to the opening of the ear canal. The speaker of earpiece 502 that may be placed over the cavum concha rather than in the cavum concha may use a larger driver, such as a 13.5 mm driver, which may increase the sound intensity of audio output from the speaker.

Earhook 504 may include arm 508 to attach earhook 504 to earpiece 502 and position earpiece 502 closer to the ear than arm 508. Arm 508 may comprise a plastic material and allow adjustment of the earhook by rotating the earhook around the earpiece. Earhook 504 may also include loop 506 to securely attach audio earphone device 500 by placing loop 506 over or behind one or more portions of the ear, such as the helix 142 of ear 140 as described for FIG. 1. Loop 506 may comprise a molded rubber material, such as silicone, that may enclose an embedded wire 518. The molded rubber material may be a soft touch material to improve user comfort, and loop 506 may be bent or otherwise adjusted to improve fit around or behind an ear.

Wire 518 may transmit and receive signals to convey audio information, such as signals necessary to drive the speaker of earpiece 502. In at least some embodiments, the signals may be transmitted or received as digital signals. For example, earpiece 502 may receive digital signals conveying audio information and convert the digital signals into analog signals for driving the speaker of earpiece 502 to generate audio output. Although wire 518 is shown, audio earphone device 500 may be battery-powered and may use wireless communication to transmit audio information.

One or more microphones for audio recording or ambient noise cancellation may be integrated into audio earphone device 500. For example, earpiece 502, earhook 504, or wire 518 may include one or more microphones that may be embedded or placed in-line. As another example, earpiece 502 may be attached to a microphone boom (not shown) that is configured to extend from a position near an ear of a user to a position near the mouth of a user.

Earpiece 502 may be removably attached to eartip 520, which may include a base 524 on the proximate end closest to earpiece 502 and rubber attachment 522 on the distal end furthest from earpiece 502. Base 524 may comprise a plastic piece, which may be co-molded to rubber attachment 522. Base 524 may include one or more feet (not shown) to securely attach eartip 520 to earpiece 502. For example, one or more feet of eartip 520 may be inserted in one or more corresponding cavities of earpiece 502 and after insertion eartip 520 may be rotated along a plane orthogonal to the direction of insertion relative to earpiece 502. A notification of a locking position may be provided by mark 516 on earpiece 502 and mark 534 on eartip 520. Marks 516 and 534 may be provided by indentations or painted symbols, such as circles or dots, on the surface of earpiece 502 and eartip 520. When marks 516 and 534 align, eartip 520 may be securely attached to earpiece 502. Conversely, eartip 520 may be removed from earpiece 502 by rotating eartip 520 relative to earpiece 502 such that marks 516 and 534 are no longer aligned and then pulling on eartip 520 to separate it from earpiece 502 once the one or more feet of eartip 520 align with the one or more corresponding cavities of earpiece 502.

When eartip 520 is attached to earpiece 502, the base 524 of eartip 520 may be substantially flush with the base 503 of earpiece 502 in which there may be no protruding edges from the base 524 of eartip 520 or base 503 of earpiece 502 that could otherwise result in discomfort during periods of use typical of public-safety and mission-critical environments. Audio output from the speaker of earpiece 502 may be channeled to the ear canal by rubber attachment 522 of the eartip 520 via port 532. A user may select an eartip 520 with the appropriately sized rubber attachment 522 that isolates audio from the ear canal without adversely interacting with the ear, which ordinarily may cause discomfort.

Figure 6A:
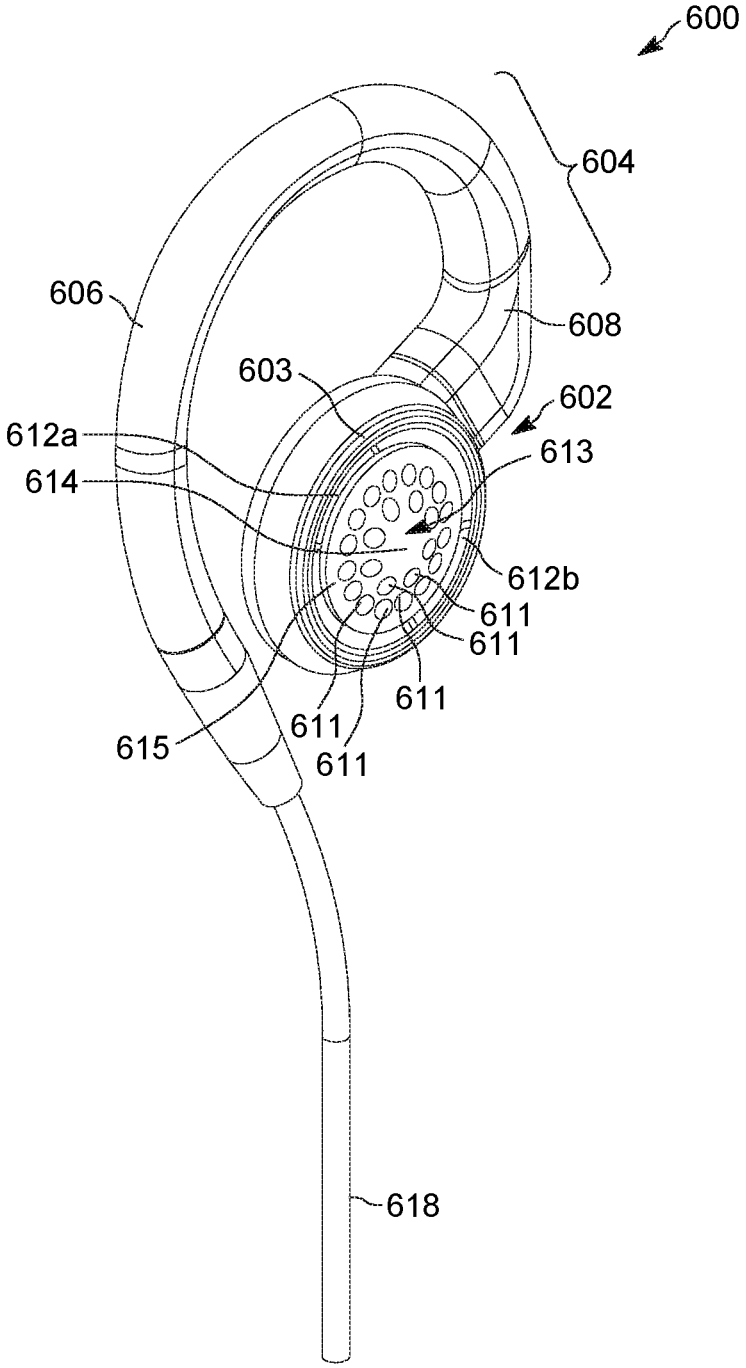
FIG. 6A is a rear inner perspective view of an example audio earphone device without an eartip, in accordance with some embodiments.
Figure 6B:
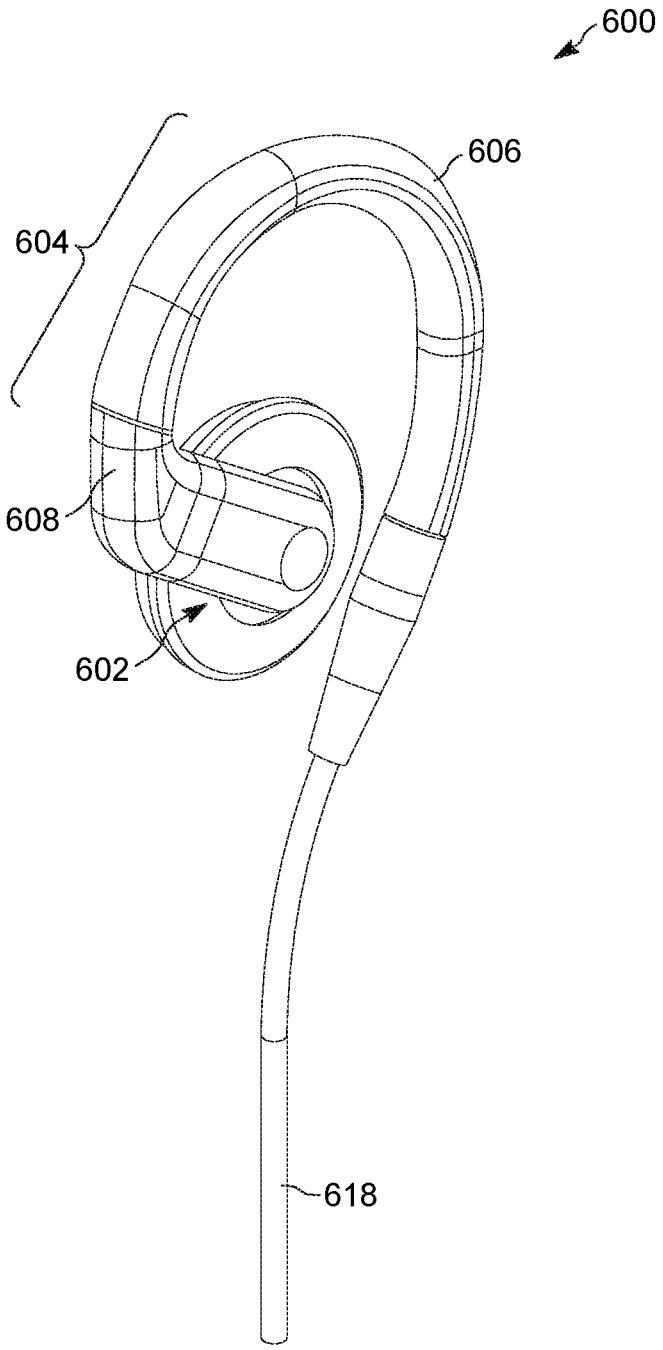
FIG. 6B is a front outer perspective view of an example audio earphone device without an eartip, in accordance with some embodiments.

Referring now to FIGS. 6A and 6B, there is provided a rear inner perspective view (FIG. 6A) and a front outer perspective view (FIG. 6B) of an example audio earphone device 600 without an eartip, in accordance with some embodiments. Audio earphone device 600 may be similar to audio earphone device 400 as described for FIGS. 4A to 4E.

Audio earphone device 600 may include an earpiece 602 and earhook 604. Although one earpiece 602 and earhook 604 are shown, audio earphone device 600 may include an earphone, which may include earpiece 602 and earhook 604, for each of a user's two ears. The pair of earphones may be communicatively coupled via a wired or wireless interface.

Earpiece 602 may include base 603 that houses a speaker (not shown) and one or more cavities for securing an eartip, such as superior cavity 612*a* and inferior cavity 612*b*. Cavities 612 may be recessed into the base 603 of earpiece 602 to avoid a protruding edge that may otherwise interface with a surface of the ear. In addition, the cavities 612 may be located outside the speaker in the base 603 of the earpiece 602, rather than towards the center of earpiece 602. Although a superior cavity 612*a* and inferior cavity 612*b* are shown, one or more cavities may be positioned any suitable location around the speaker.

The speaker may be covered with a speaker grill 613 to protect one or more components of the speaker from damage, including but not limited to the diaphragm of the speaker. Speaker grill 613 may include one or more openings 611 to allow sound to be transmitted away from the speaker of earpiece 602. Although a plurality of circular openings 611 are shown, any number of openings having any suitable shape may be used to transmit sound from the speaker. Speaker grill 613 may form a conical shape with a base 615 and an apex 614. Base 615 of speaker grill 613 may be configured to be further away from the cavum of a user's ear, which may provide improved comfort by avoiding interactions between a surface of the ear and a surface of speaker grill 613. In addition, openings 611 may at least partially channel sound from the speaker to the opening of the ear canal, which may provide improved sound intensity at the ear. Apex 614 of speaker grill 613 may extend from the base 603 of earpiece 602 toward the opening of the ear canal, which may improve the sound intensity of audio delivered to the ear. In some embodiments, the base 615 of speaker grill 613 may be recessed relative to the base 603 of earpiece 602, which may ensure that earpiece 602 be placed over the cavum concha, rather than in the cavum concha, which may improve user comfort. The speaker of earpiece 602 that may be placed over the cavum concha rather than in the cavum concha may use a larger driver, such as a 13.5 mm driver, which may increase the sound intensity of audio output from the speaker.

Earhook 604 may include arm 608 to attached earhook 604 to earpiece 602 and position earpiece 602 closer to the ear than arm 608. Arm 608 may comprise a plastic material and allow adjustment of the earhook by rotating the earhook around the earpiece. Earhook 604 may also include loop 406 to securely attach audio earphone device 600 by placing loop 606 over or behind one or more portions of the ear, such as the helix. Loop 606 may comprise a molded rubber material, such as silicone, that may enclose an embedded wire 618. The molded rubber material may be a soft-touch material to improve user comfort, and loop 606 may be bent or otherwise adjusted to improve fit around or behind an ear.

Wire 618 may transmit and receive signals to convey audio information, such as signals necessary to drive the speaker of earpiece 602. In at least some embodiments, the signals may be transmitted or received as digital signals. For example, earpiece 602 may receive digital signals conveying audio information and convert the digital signals into analog signals for driving the speaker of earpiece 602 to generate audio output. Although wire 618 is shown, audio earphone device 600 may be battery-powered and may use wireless communication to transmit audio information.

One or more microphones for audio recording or ambient noise cancellation may be integrated into audio earphone device 600. For example, earpiece 602, earhook 604, or wire 618 may include one or more microphones that may be embedded or placed in-line. As another example, earpiece 602 may be attached to a microphone boom (not shown) that is configured to extend from a position near an ear of a user to a position near the mouth of a user.

Figure 7:
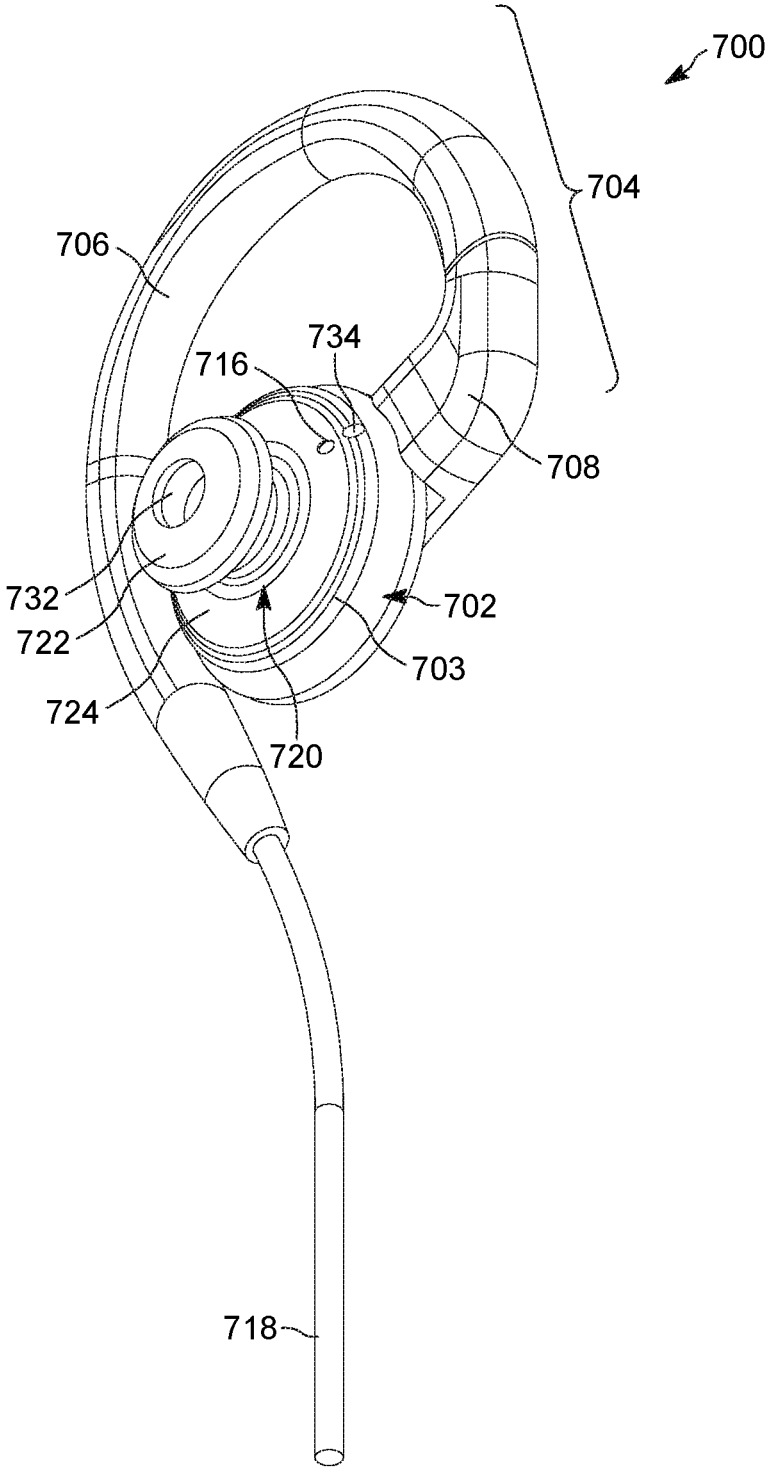
FIG. 7 is a front inner perspective view of an example audio earphone device with an eartip, in accordance with some embodiments.

Referring now to FIG. 7, there is provided a front inner perspective view of an example audio earphone device 700 with an eartip 720, in accordance with some embodiments. Audio earphone device 700 may be similar to audio earphone device 500 as described for FIGS. 5A to 5E.

Audio earphone device 700 may include an earpiece 702, earhook 704, and removable eartip 720. Although one earpiece 702, earhook 704, and removable eartip 720 are shown, audio earphone device 700 may include an earphone, which may include an earpiece 702, earhook 704, and removable eartip 720, for each of a user's two ears. The pair of earphones may be communicatively coupled by a wired or wireless interface. Earpiece 702 may include a base 703 that houses a speaker (not shown), and one or more cavities (not shown) for securing eartip 720. Eartip 720 may be removably attached to one side of earpiece 702 that is configured to be proximate to the ear. Earpiece 702 may be placed over the cavum concha, rather than in the cavum concha, and eartip 720 may be placed in the cavum concha to channel audio to the opening of the ear canal. The speaker of earpiece 702 that may be placed over the cavum concha rather than in the cavum concha may use a larger driver, such as a 13.5 mm driver, which may increase the sound intensity of audio output from the speaker.

Earhook 704 may include arm 708 to attach earhook 704 to earpiece 702 and position earpiece 702 closer to the ear than arm 708. Arm 708 may comprise a plastic material and allow adjustment of the earhook by rotating the earhook around the earpiece. Earhook 704 may also include loop 706 to securely attach audio earphone device 700 by placing loop 706 over or behind one or more portions of the ear, such as the helix 142 of ear 140 as described for FIG. 1. Loop 706 may comprise a molded rubber material, such as silicone, that may enclose an embedded wire 718. The molded rubber material may be a soft touch material to improve user comfort, and loop 706 may be bent or otherwise adjusted to improve fit around or behind an ear.

Wire 718 may transmit and receive signals to convey audio information, such as signals necessary to drive the speaker of earpiece 702. In at least some embodiments, the signals may be transmitted or received as digital signals. For example, earpiece 702 may receive digital signals conveying audio information and convert the digital signals into analog signals for driving the speaker of earpiece 702 to generate audio output. Although wire 718 is shown, audio earphone device 700 may be battery-powered and may use wireless communication to transmit audio information.

One or more microphones for audio recording or ambient noise cancellation may be integrated into audio earphone device 700. For example, earpiece 702, earhook 704, or wire 718 may include one or more microphones that may be embedded or placed in-line. As another example, earpiece 702 may be attached to a microphone boom (not shown) that is configured to extend from a position near an ear of a user to a position near the mouth of a user.

Earpiece 702 may be removably attached to eartip 720, which may include a base 724 on the proximate end closest to earpiece 702 and rubber attachment 722 on the distal end furthest from earpiece 702. Base 724 may comprise a plastic piece, which may be co-molded to rubber attachment 722. Base 724 may include one or more feet (not shown) to securely attach eartip 720 to earpiece 702. For example, one or more feet of eartip 720 may be inserted in one or more corresponding cavities of earpiece 702 and after insertion eartip 720 may be rotated along a plane orthogonal to the direction of insertion relative to earpiece 702. A notification of a locking position may be provided by mark 716 on earpiece 702 and mark 734 on eartip 720. Marks 716 and 734 may be provided by indentations or painted symbols, such as circles or dots, on the surface of earpiece 702 and eartip 720. When marks 716 and 734 align, eartip 720 may be securely attached to earpiece 702. Conversely, eartip 720 may be removed from earpiece 702 by rotating eartip 720 relative to earpiece 702 such that marks 716 and 734 are no longer aligned and then pulling on eartip 720 to separate it from earpiece 702 once the one or more feet of eartip 720 align with the one or more corresponding cavities of earpiece 702.

When eartip 720 is attached to earpiece 702, the base 724 of eartip 720 may be substantially flush with the base 703 of earpiece 702 in which there may be no protruding edges from the base 724 of eartip 720 or base 703 of earpiece 702 that could otherwise result in discomfort during periods of use typical of public-safety and mission-critical environments. Audio output from the speaker of earpiece 702 may be channeled to the ear canal by rubber attachment 722 of the eartip 720 via port 732. A user may select an eartip 720 with the appropriately sized rubber attachment 722 that isolates audio from the ear canal without adversely interacting with the ear, which ordinarily may cause discomfort.

Figure 8A:
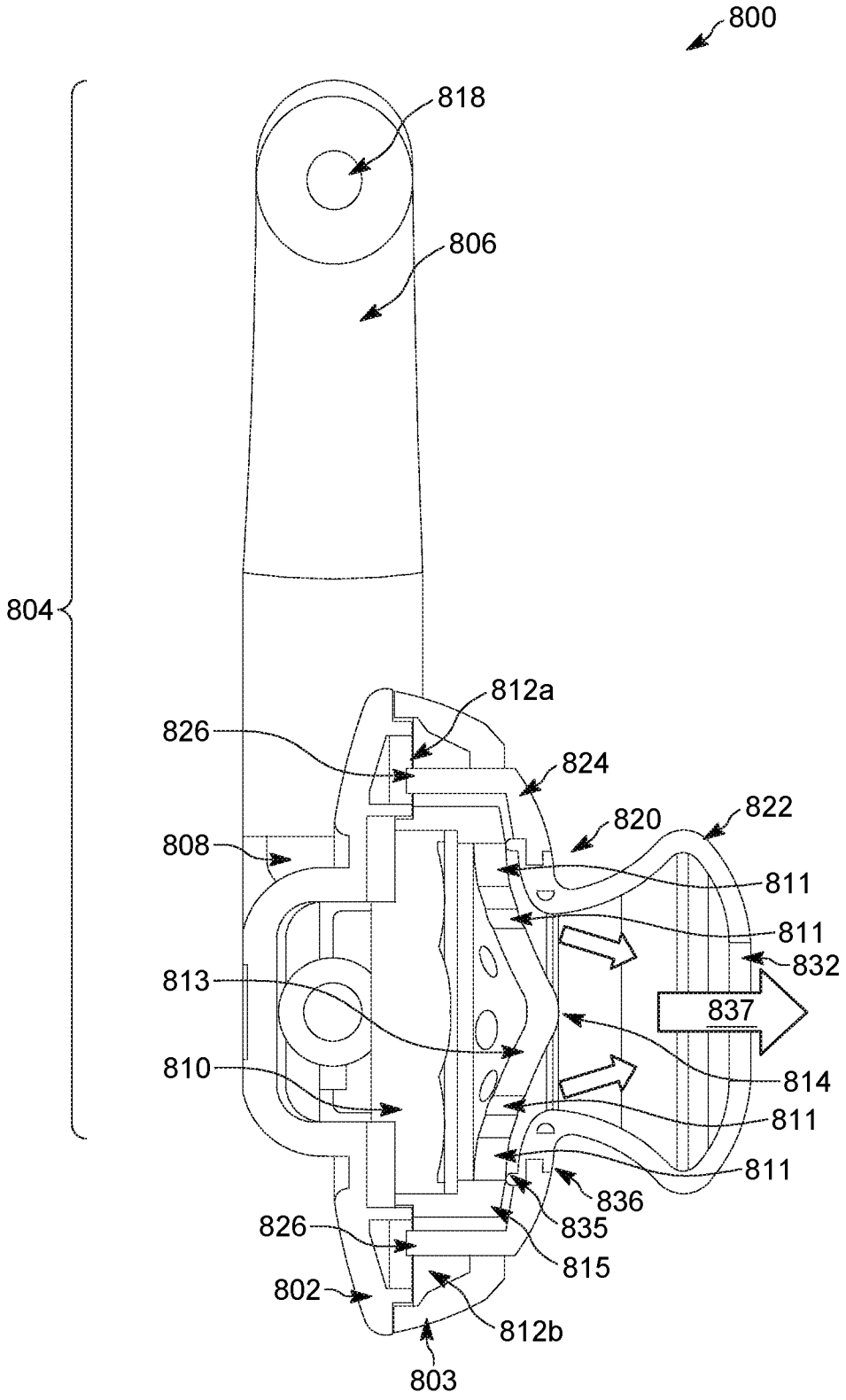
FIG. 8A is a rear side orthogonal cross-sectional view of an example audio earphone device, in accordance with some embodiments.

Referring now to FIG. 8A, there is provided a rear side orthogonal cross-sectional view of an example audio earphone device 800, in accordance with some embodiments. Audio earphone device 800 may include earpiece 802, earhook 804, and removable eartip 820. Although one earpiece 802, earhook 804, and removable eartip 820 are shown, audio earphone device 800 may include an earphone, which may include an earpiece 802, earhook 804, and removeable eartip 820, for each of a user's two ears. The pair of earphones may be communicatively coupled together by a wire or wireless interface.

Earpiece 802 may include base 803 that houses speaker 810, which may include one or more components, such as a diaphragm, coil, and magnet. Base 803 of earpiece 802 may also house one or more cavities, such as superior cavity 812*a* and inferior cavity 812*b*. Cavities 812 may be recessed into the base 803 of earpiece 802 to avoid a protruding edge that may otherwise interface with a surface of the ear. In addition, the cavities 812 may be located outside the speaker 810 in the base 803 of the earpiece 802, rather than towards the center of earpiece 802. Although a superior cavity 812*a* and inferior cavity 812*b* are shown, one or more cavities may be positioned at any suitable location around the speaker 810.

In some embodiments, the speaker 810 of earpiece 802 may be covered with a speaker grill 813 of earpiece 802 to protect one or more components of speaker 810 from damage, including but not limited to the diaphragm of speaker 810. Speaker grill 813 may include one or more openings 811 to allow sound to be transmitted away from speaker 810 of earpiece 802. Although a plurality of cylindrical openings 811 are shown, any number of openings in speaker grill 813 having any suitable shape may be used to transmit sound from speaker 810. Speaker grill 813 may form a conical shape with a base 815 and an apex 814. Base 815 of speaker grill 813 may be configured to be further away from the cavum of a user's ear than apex 814, which may provide improved comfort by avoiding interactions between a surface of the ear and a surface of speaker grill 813. In addition, openings 811 of speaker grill 813 may at least partially channel sound from the speaker 810 to the opening of the ear canal, which may provide improved sound intensity at the ear. Apex 814 of speaker grill 813 may extend from the base 803 of earpiece 802 toward the opening of the ear canal, which may improve the sound intensity of audio delivered to the ear. In some embodiments, the base 815 of speaker grill 813 may be recessed relative to the base 803 of earpiece 802. The recessed location may improve the secure fit of an eartip and ensure that earpiece 802 be placed over the cavum concha, rather than in the cavum concha, which may improve comfort. The speaker of earpiece 802 that may be placed over the cavum concha rather than in the cavum concha may use a larger driver, such as a 13.5 mm driver, which may increase the sound intensity of audio output from the speaker.

Earhook 804 may include arm 808 to attach earhook 804 to earpiece 802 and position earpiece 802 closer to the ear than arm 808. Arm 808 may comprise a plastic material and allow adjustment of the earhook 804 by rotating the earhook 804 around earpiece 802. Earhook 804 may also include loop 806 to securely attach audio earphone device 800 by placing loop 806 over or behind one or more portions of the ear, such as the helix. Loop 806 may comprise a molded rubber material, such as silicone, that may enclose an embedded wire 818. The molded rubber material may be a soft-touch material to improve user comfort, and loop 806 may be bent or otherwise adjusted to improve fit around or behind an ear.

Wire 818 may transmit and receive signals to convey audio information, such as signals necessary to drive the speaker of earpiece 802. In at least some embodiments, the signals may be transmitted or received as digital signals. For example, earpiece 802 may receive digital signals conveying audio information and convert the digital signals into analog signals for driving the speaker 810 of earpiece 802 to generate audio output. Although wire 818 is shown, audio earphone device 800 may be battery-powered and may use wireless communication to transmit audio information.

One or more microphones for audio recording or ambient noise cancellation may be integrated into audio earphone device 800. For example, earpiece 802, earhook 804, or wire 818 may include one or more microphones that may be embedded or placed in-line. As another example, earpiece 802 may be attached to a microphone boom (not shown) that is configured to extend from a position near an ear of a user to a position near the mouth of a user.

Earpiece 802 may be removably attached to eartip 820, which may include a base 824 on the proximate end closest to earpiece 802 and rubber attachment 822 on the distal end furthest from earpiece 802. In some embodiments, base 824 may comprise one or more plastic pieces, which may be co-molded to rubber attachment 822. Base 824 may include one or more feet 826 to attach eartip 820 to earpiece 802 in a secure manner. Eartip 820 may be removably attached to one side of earpiece 802 that is configured to be proximate to the ear. The feet 826 may be configured to interlock the eartip 820 to the earpiece 802 via contact by interfacing with a wall of a cavity 812 of the earpiece 802, such as a wall of cavity 812*a* or 812*b* of earpiece 802. In some embodiments, the feet 826 may be formed with a curvature, which may correspond to the curvature of a cavity, such as cavity 812*a* or 812*b*, or a base, such as base 803 of earpiece 802. For example, one or more feet 826 of eartip 820 may be inserted in one or more corresponding cavities 812 of earpiece 802, such as superior cavity 812*a* and cavity 812*b*. After being inserted, eartip 820 may be rotated along a plane orthogonal to the direction of insertion relative to earpiece 802. A notification of a locking position may be provided by a mark (not shown) on earpiece 802 and another mark (not shown) on eartip 820. When the two marks align, eartip 820 may be securely attached to earpiece 802. Conversely, eartip 820 may be removed from earpiece 802 by rotating eartip 820 relative to earpiece 802 such that the two marks are no longer aligned and then pulling on eartip 820 to separate it from earpiece 802 once the one or more feet 826 of eartip 820 align with the one or more corresponding cavities 812 of earpiece 802.

When eartip 820 is attached to earpiece 802, the base 824 of eartip 820 may be substantially flush with the base 803 of earpiece 802 in which there may be no protruding edges from the base 824 of eartip 820 or base 803 of earpiece 802 that could otherwise result in discomfort during periods of use typical of public-safety and mission-critical environments. Audio output from the speaker grill 813 of earpiece 802 may be channeled to the ear canal by rubber attachment 822 of the eartip 820 via port 832. A rubber seal 835 of rubber attachment 822 may provide a seal with base 815 of speaker grill 813 to reduce sound leakage and increase the intensity of sound channeled 837 to the port 832 of rubber attachment 822. In some embodiments, rubber attachment 822 may be co-molded with base 824 of eartip 820 with an attachment joint 836 to provide another seal to reduce sound leakage and increase the intensity of sound channeled 837 to the port 832 of rubber attachment 822. A user may select an eartip 820 with the appropriately sized rubber attachment

822 that isolates audio from the ear canal without adversely interacting with the ear, which ordinarily may cause discomfort.

Figure 8B:
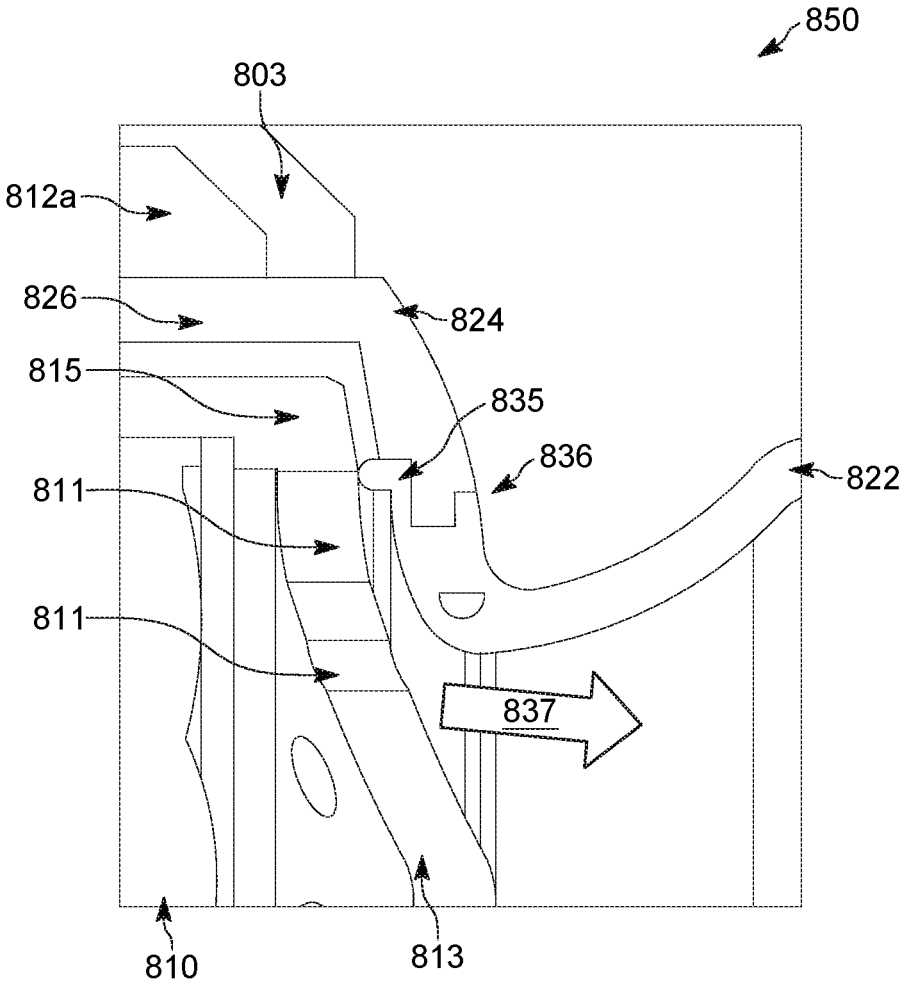
FIG. 8B is a zoomed-in rear side orthogonal cross-sectional view of an example audio earphone device, in accordance with some embodiments.

Referring now to FIG. 8B, there is provided a zoomed-in rear side orthogonal cross-sectional view of an example audio earphone 850, in accordance with some embodiments. Audio earphone device 850 may be similar to audio earphone device 800 as described for FIG. 8A. The earpiece of audio earphone device 850 may include base 803 that houses speaker 810, which may include one or more components, such as a diaphragm, coil, and magnet. Base 803 may also house one or more cavities, such as superior cavity 812*a*. Although superior cavity 812*a* is shown, one or more cavities may be positioned at any suitable location around the speaker 810.

In some embodiments, speaker 810 may be covered with speaker grill 813 to protect one or more components of speaker 810 from damage, including but not limited to the diaphragm of speaker 810. Speaker grill 813 may include one or more openings 811 to allow sound to be transmitted away from speaker 810. Although a plurality of cylindrical openings 811 are shown, any number of openings in speaker grill 813 having any suitable shape may be used to transmit sound from speaker 810. Speaker grill 813 may form a conical shape. Base 815 of speaker grill 813 may be configured to be further away from the cavum of a user's ear than the apex (not shown) of speaker grill 813, which may provide improved comfort by avoiding interactions between a surface of the ear and a surface of speaker grill 813. In addition, openings 811 of speaker grill 813 may at least partially channel sound from speaker 810 to the opening of the ear canal, which may provide improved sound intensity at the ear. Apex of speaker grill 813 may extend from the base 803 of earpiece 802 toward the opening of the ear canal, which may improve the sound intensity of audio delivered to the ear. In some embodiments, the base 815 of speaker grill 813 may be recessed relative to the base 803. The recessed location may improve the secure fit of an eartip and ensure that earpiece be placed over the cavum concha, rather than in the cavum concha, which may improve user comfort.

The earpiece of audio earphone device 850 may be removably attached to the eartip, which may include a base 824 on the proximate end closest to the earpiece and rubber attachment 822 on the distal end furthest from the earpiece. In some embodiments, base 824 may comprise one or more plastic pieces, which may be co-molded to rubber attachment 822. Base 824 may include one or more feet 826 to attach the eartip to the earpiece in a secure manner. For example, one or more feet 826 the eartip may be inserted in one or more corresponding cavities 812 of the earpiece, such as superior cavity 812*a*. After being inserted, the eartip may be rotated along a plane orthogonal to the direction of insertion relative to the earpiece.

When the eartip is attached to the earpiece, the base 824 of the eartip may be substantially flush with the base 803 of the earpiece in which there may be no protruding edges from the base 824 or base 803 that could otherwise result in discomfort during periods of use typical of public-safety and mission-critical environments. Audio output from the speaker grill 813 of earpiece 802 may be channeled to the ear canal by rubber attachment 822 of the eartip, as shown by 837. A rubber seal 835 of rubber attachment 822 may provide a seal with base 815 of speaker grill 813 to reduce sound leakage and increase the intensity of sound channeled 837 to the ear by rubber attachment 822. In some embodiments, rubber attachment 822 may be co-molded with base 824 with an attachment joint 836 to provide another seal to reduce sound leakage and increase the intensity of sound channeled 837.

Figure 9:
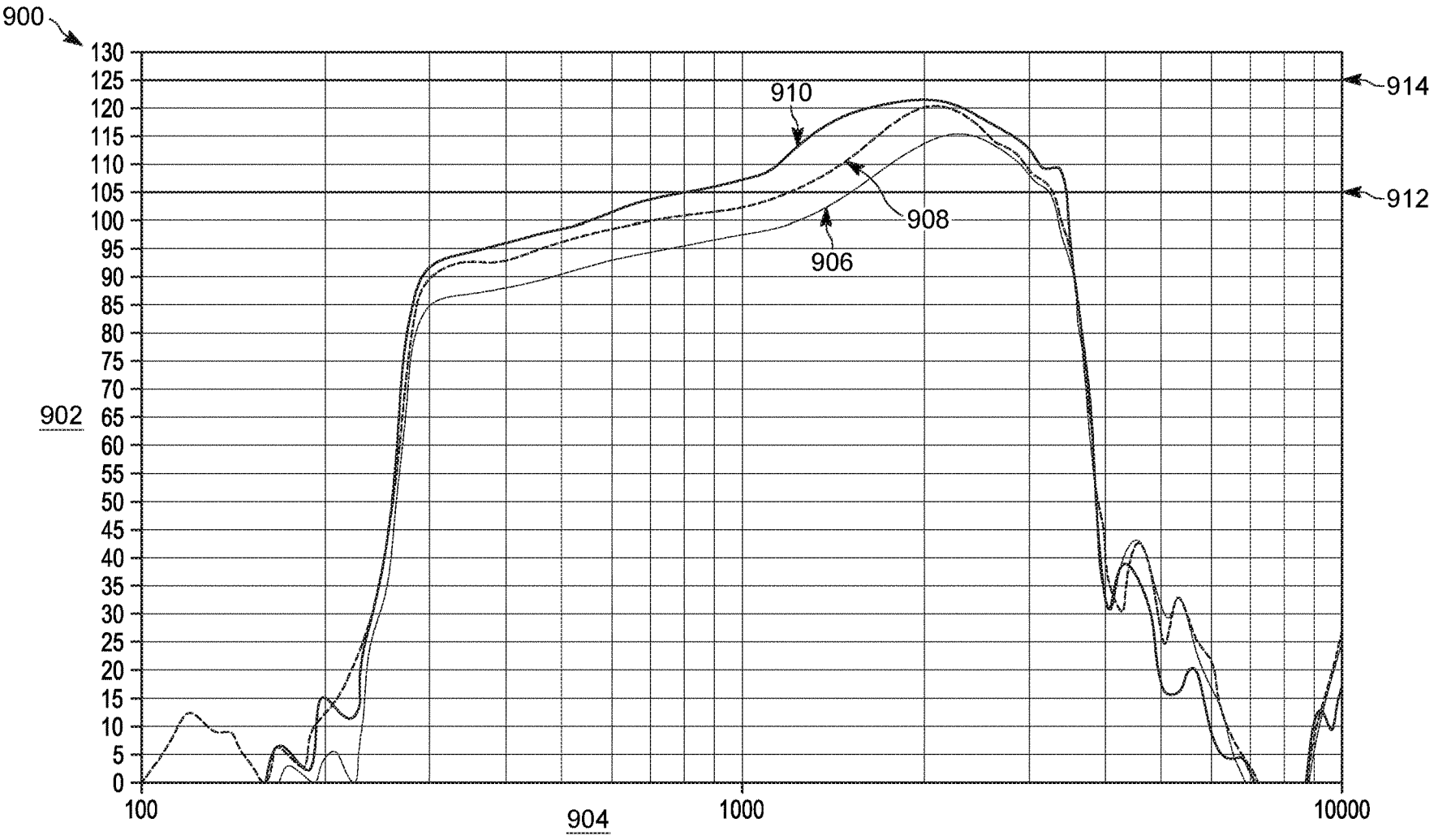
FIG. 9 is a sound intensity chart of an example audio earphone device, in accordance with some embodiments.

Referring now to FIG. 9, there is provided a sound intensity chart 900 of an example audio earphone device, in accordance with some embodiments. The vertical axis 902 may represent sound intensity in a-weighted decibels (db (A)) of sound pressure level (SPL). The horizontal axis 904 may represent frequency of audio in hertz (Hz) with a logarithmic scale. Sound intensity waveform 906 may represent an earpiece and earhook without an eartip in which the audio earphone device is casually fitted to an ear without pressing the audio earphone device against the ear. Sound intensity waveform 908 may represent an earpiece and earhook without an eartip in which the audio earphone device is press fitted against the ear. In addition, sound intensity waveform 910 may represent an earpiece, earhook, and eartip in which the earhook is fitted above or over the ear in a normal manner.

Minimum sound intensity threshold 912 may represent the minimum acceptable sound output capability of an audio earphone device, such as 105 db(A) SPL, and maximum sound intensity threshold 914 may represent the maximum acceptable sound output capability of the audio earphone device, such as 125 db(A) SPL. At approximately 1000 Hz, sound intensity waveform 906 may have a sound intensity of approximately 97.5 db(A) SPL, sound intensity waveform 908 may have a sound intensity of approximately 102.5 db(A) SPL, and sound intensity waveform 910 may have a sound intensity of approximately 107.5 db(A) SPL. Moreover, at approximately 2000 Hz, sound intensity waveform 906 may have a sound intensity of approximately 114 db(A) SPL, sound intensity waveform 908 may have a sound intensity of approximately 119 db(A) SPL, and sound intensity waveform 910 may have a sound intensity of approximately 121 db(A) SPL. In some embodiments, the sound intensity associated with an audio earphone device with an eartip may be less than 15 db(A) SPL greater than the sound intensity associated with the audio earphone device without the eartip.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element preceded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized electronic processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer-readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and integrated circuits (ICs) with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of any single disclosed embodiment. Thus, the following claims are hereby incorporated into the Detailed Description, with each claim standing on its own as a separately claimed subject matter.

We claim:

1. An audio earphone device, comprising:

an earpiece configured to playback audio;

an earhook attached to the earpiece, the earhook configured to be placed around an ear to position an opening for a speaker of the earpiece over the cavum concha of the ear; and an eartip removably attached to the earpiece, the eartip configured to channel audio from the opening of the earpiece to the ear canal of the ear, wherein:

the eartip is removably attached to only a side of the earpiece, the side configured to be proximate to the ear;

the eartip is configured to sit in the cavum concha of the ear;

the earpiece is configured to deliver audio to the ear with the removably attached eartip removed;

a speaker grill of the earpiece with the opening for the speaker has a conical shape;

the apex of the speaker grill extends from the earpiece;

the eartip is configured to be removably attached to the earpiece with a foot of the eartip configured to interlock the eartip to the earpiece by:

inserting the foot of the eartip into a cavity of the earpiece, the cavity of the earpiece recessed from the apex of the speaker grill of the earpiece; and rotating the eartip to a locking position.

2. The audio earphone device of claim 1, wherein the earhook is configured to position the opening of the earpiece over the cavum concha of the ear using a loop configured to be placed around the helix of the ear.

3. The audio earphone device of claim 2, wherein:

the earhook is attached to the earpiece by an arm of the earhook; and the loop of the earhook comprises a molded rubber material with an embedded wire within the molded rubber material.

4. The audio earphone device of claim 3, wherein the molded rubber material comprises silicone.

5. The audio earphone device of claim 3, wherein the earpiece is configured to be positioned closer to the ear than the attached arm of the earhook.

6. The audio earphone device of claim 1, wherein a distal end of the eartip comprises a rubber attachment configured to isolate ambient sound from the ear canal.

7. The audio earphone device of claim 6, wherein the rubber attachment comprises silicone.

8. The audio earphone device of claim 1, a first sound intensity corresponding to audio configured to be delivered by the earpiece to the ear with the eartip removed is lower than a second sound intensity corresponding to audio configured to be delivered by the earpiece and channeled by the eartip to the ear.

9. The audio earphone device of claim 1, wherein:

the earpiece is configured to deliver audio having a first sound pressure level to the ear;

the eartip is configured to channel audio having a second sound pressure level to the ear; and the second sound pressure level is less than 15 decibels greater than the first sound pressure level.

10. The audio earphone device of claim 1, wherein the eartip comprises:

a rubber attachment on the distal end of the eartip, the rubber attachment comprising a port configured to be positioned toward the ear canal; and a plastic base with the foot on the proximate end of the eartip, wherein the plastic base is co-molded to the rubber attachment.

11. The audio earphone device of claim 10, wherein the plastic base of the eartip is configured to be substantially flush with the earpiece when the eartip is interlocked with the earpiece.

12. The audio earphone device of claim 1, wherein a curvature of the foot corresponds to a curvature of a base of the earpiece, the base configured to house the speaker of the earpiece.

13. The audio earphone device of claim 1, wherein the locking position is identified by a first mark on the earpiece aligned to a second mark on the eartip.

14. The audio earphone device of claim 1, wherein the rotation of the eartip to the locking position is configured to be performed on a plane of rotation orthogonal to an axis of the insertion of the foot of the eartip into the cavity of the earpiece.

15. The audio earphone device of claim 1, wherein the cavity of the earpiece is recessed into a base of the earpiece, the base configured to house the speaker of the earpiece.

16. The audio earphone device of claim 1, wherein the foot is configured to interlock the eartip to the earpiece by interfacing with a wall of the cavity.

17. The audio earphone device of claim 10, wherein a sloped edge of the foot is formed by:

a first end of the foot, the first end distal to the plastic base of the eartip; and a second end of the foot, the second end proximate to the plastic base, wherein the sloped edge is configured to secure the eartip to the earpiece.

* * * * *